US006232585B1

(12) United States Patent
Clothier et al.

(10) Patent No.: US 6,232,585 B1
(45) Date of Patent: May 15, 2001

(54) TEMPERATURE SELF-REGULATING FOOD DELIVERY SYSTEM

(75) Inventors: Brian L. Clothier, Montgomery, AL (US); Amil J. Ablah, Wichita, KS (US)

(73) Assignee: Thermal Solutions, Inc., Wichita, KS (US)

( * ) Notice: Subject to any disclaimer, the term of this patent is extended or adjusted under 35 U.S.C. 154(b) by 0 days.

(21) Appl. No.: 09/314,827

(22) Filed: May 19, 1999

Related U.S. Application Data

(60) Provisional application No. 60/086,033, filed on May 19, 1998.

(51) Int. Cl.[7] ..... H05B 6/12; H05B 6/06

(52) U.S. Cl. ..... 219/620; 219/621; 219/622; 219/624; 219/626; 219/647; 99/451; 99/DIG. 14; 126/246; 340/572.1; 340/825.37

(58) Field of Search ..... 219/621, 622, 219/624, 620, 647, 649, 387, 626, 627; 99/DIG. 14, 451; 126/246, 375, 275, 400; 340/825.36, 825.37, 825.54, 572.1

(56) References Cited

U.S. PATENT DOCUMENTS

| | | | |
|---|---|---|---|
| 1,975,436 | | 10/1934 | Sorrel et al. . |
| 1,975,437 | | 10/1934 | Sorrel . |
| 1,975,438 | | 10/1934 | Sorrel . |
| 3,734,077 | | 5/1973 | Murdough et al. . |
| 3,745,290 | | 7/1973 | Harnden, Jr. et al. . |
| 3,777,094 | | 12/1973 | Peters, Jr. . |
| 3,843,857 | * | 10/1974 | Cunningham ..... 219/624 |
| 3,916,872 | | 11/1975 | Kreis et al. . |
| 3,978,307 | | 8/1976 | Amagami et al. . |
| 3,979,572 | | 9/1976 | Ito et al. . |
| 4,020,310 | | 4/1977 | Souder, Jr. et al. . |

(List continued on next page.)

FOREIGN PATENT DOCUMENTS

| | | | |
|---|---|---|---|
| 2 308 947 | * | 7/1997 | (GB) . |
| 6463289 | | 3/1989 | (JP) . |
| 6489273 | | 4/1989 | (JP) . |

OTHER PUBLICATIONS

Metcal, The SmartHeat Company; Metcal SSC Soldering Cartridges.

Metcal, The SmartHeat Company; Metcal Tips and Accessories.

Metcal, The SmartHeat Company; Metcal STSS Systems.

Seco Products Corporation; Healthcare Mini Catalog.

Seco Products Corporation; System 9–9" Unitized Base.

Seco Products Corporation; System 9–Molded Cover for 9" Unitized Base, System 7–Molded Cover for 7–3/4" Unitized Base.

(List continued on next page.)

*Primary Examiner*—Philip H. Leung
(74) *Attorney, Agent, or Firm*—Hovey, Williams, Timmons & Collins

(57) ABSTRACT

Temperature self-regulating food delivery systems are provided having a magnetic induction heater (32, 126) and an associated food container (76, 124) equipped with an essentially permanent ferromagnetic heating element (82, 100, 128). The heater (32, 126) and heating elements (82,100, 128) are designed so as to heat the element (82, 100, 128) to a user-selected regulation temperature when the elements (82, 100, 128) are coupled with the heater's magnetic field, and to maintain the temperature in the vicinity of the regulation temperature indefinitely temperature regulation is a heating achieved by periodically determining at least two parameters of the heaters resonant circuits related to the amplitude of the resonant current passing therethrough during heating and responsively altering the field strength of the magnetic field. Preferably, the value of the resonant circuit amplitude and the rate of change of the amplitude are determined.

25 Claims, 11 Drawing Sheets

U.S. PATENT DOCUMENTS

| | | | | |
|---|---|---|---|---|
| 4,110,587 | | 8/1978 | Souder, Jr. et al. . | |
| 4,115,676 | | 9/1978 | Higuchi et al. . | |
| 4,235,282 | | 11/1980 | de Filippis et al. . | |
| 4,246,884 | | 1/1981 | Vandas . | |
| 4,256,945 | | 3/1981 | Carter et al. . | |
| 4,266,108 | | 5/1981 | Anderson et al. . | |
| 4,527,031 | | 7/1985 | Aparicio . | |
| 4,533,807 | | 8/1985 | Minamida . | |
| 4,544,818 | | 10/1985 | Minamida . | |
| 4,567,877 | | 2/1986 | Sepahpur . | |
| 4,572,864 | | 2/1986 | Benson et al. . | |
| 4,614,852 | | 9/1986 | Matsushita et al. . | |
| 4,625,098 | | 11/1986 | Joe . | |
| 4,646,935 | | 3/1987 | Ulam . | |
| 4,774,395 | | 9/1988 | Yabuuchi et al. . | |
| 4,776,386 | | 10/1988 | Meier . | |
| 4,816,646 | * | 3/1989 | Solomon et al. | 219/387 |
| 4,914,267 | | 4/1990 | Derbyshire . | |
| 4,916,290 | * | 4/1990 | Hawkins | 219/387 |
| 4,982,722 | | 1/1991 | Wyatt . | |
| 4,983,798 | | 1/1991 | Eckler et al. . | |
| 4,987,828 | | 1/1991 | Nuns et al. . | |
| 4,996,405 | * | 2/1991 | Poumay | 219/624 |
| 5,125,391 | | 6/1992 | Srivastava et al. . | |
| 5,129,314 | | 7/1992 | Hu . | |
| 5,180,075 | | 1/1993 | Montalbano . | |
| 5,194,708 | | 3/1993 | Carter, Jr. . | |
| 5,202,150 | | 4/1993 | Benson et al. . | |
| 5,227,597 | | 7/1993 | Dickens et al. . | |
| 5,254,380 | | 10/1993 | Salyer . | |
| 5,424,519 | | 6/1995 | Salee . | |
| 5,466,915 | | 11/1995 | Meier et al. . | |
| 5,487,329 | | 1/1996 | Fissler . | |
| 5,530,702 | * | 6/1996 | Palmer et al. | 370/85.3 |
| 5,603,858 | | 2/1997 | Wyatt et al. . | |
| 5,611,328 | | 3/1997 | McDermott . | |
| 5,643,485 | | 7/1997 | Potter et al. . | |
| 5,750,962 | | 5/1998 | Hyatt . | |
| 5,880,435 | | 3/1999 | Bostic . | |
| 5,885,636 | | 3/1999 | Carville . | |
| 5,892,202 | | 4/1999 | Baldwin et al. . | |
| 5,932,129 | | 8/1999 | Hyatt . | |
| 6,018,143 | * | 1/2000 | Check | 219/387 |

OTHER PUBLICATIONS

Seco Products Corporation; Unitized Base Dispenser.
Seco Products Corporation; System 9–Combination Base/China Dispenser Base/Tray Dispenser.
Carter–Hoffmann Corp.; Patient meal make–up and delivery systems offer you better choices.
Therma–systems Corporation; Solutions Made Easy.

* cited by examiner

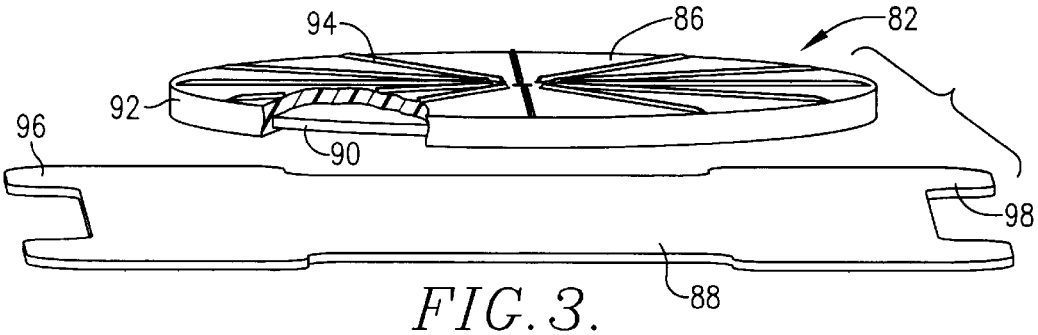
FIG. 3.
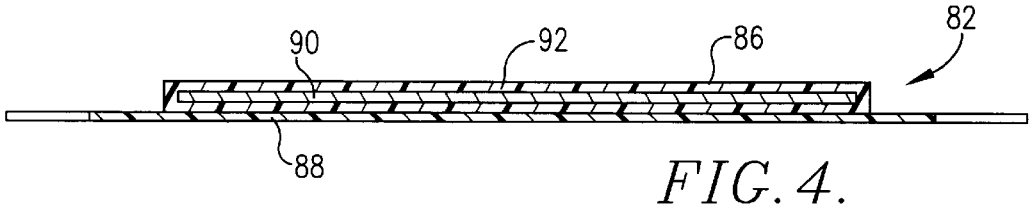
FIG. 4.
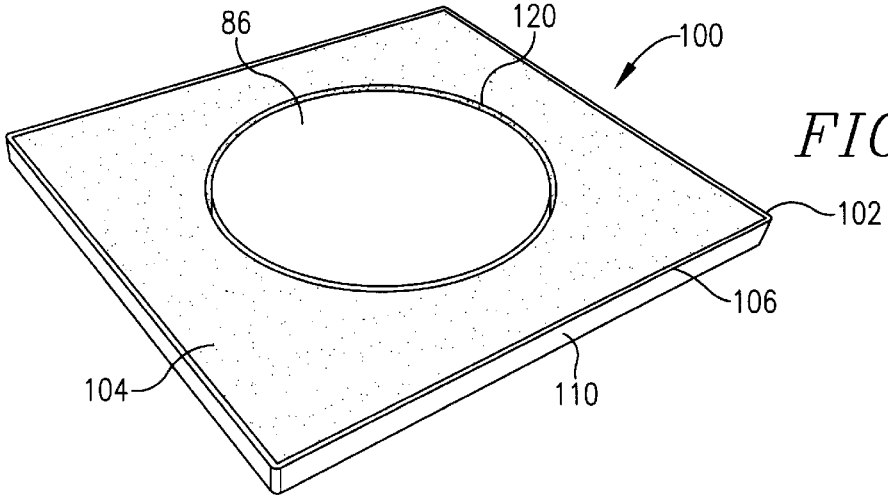
FIG. 5.
FIG. 6.
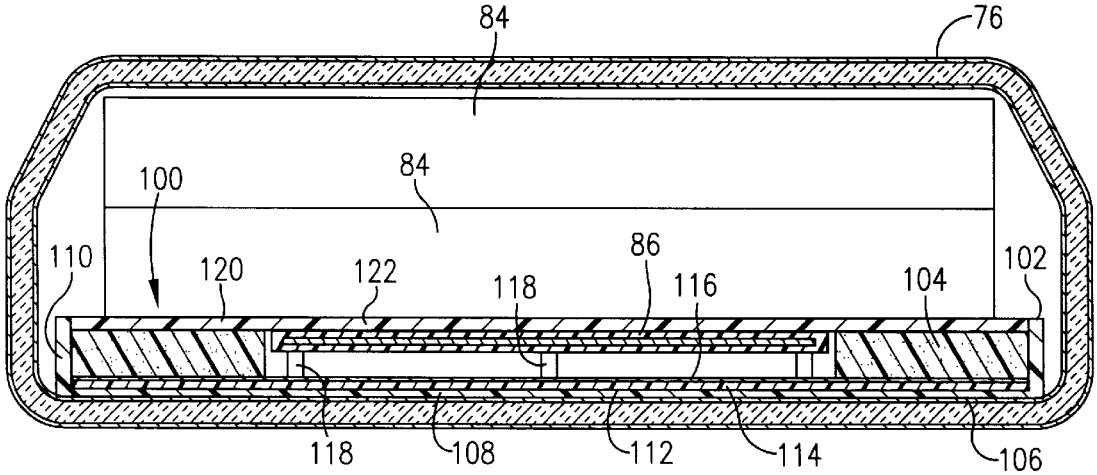

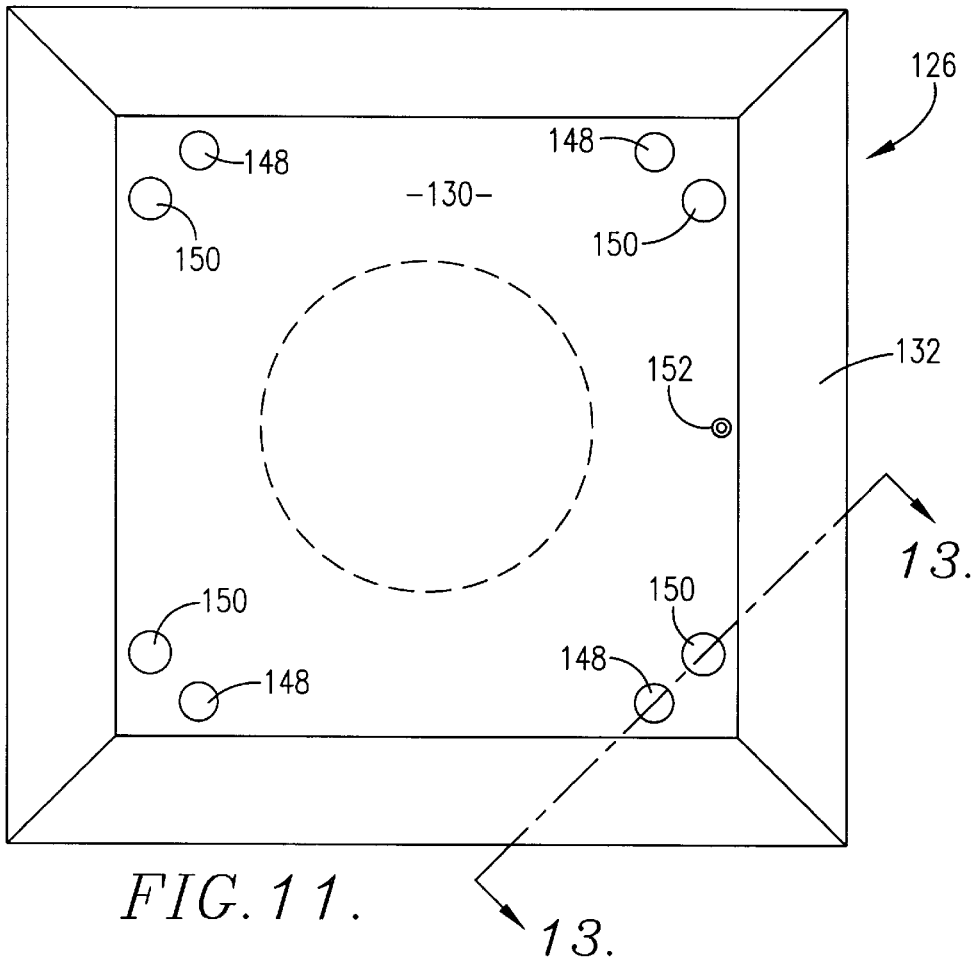
FIG. 11.
FIG. 12.
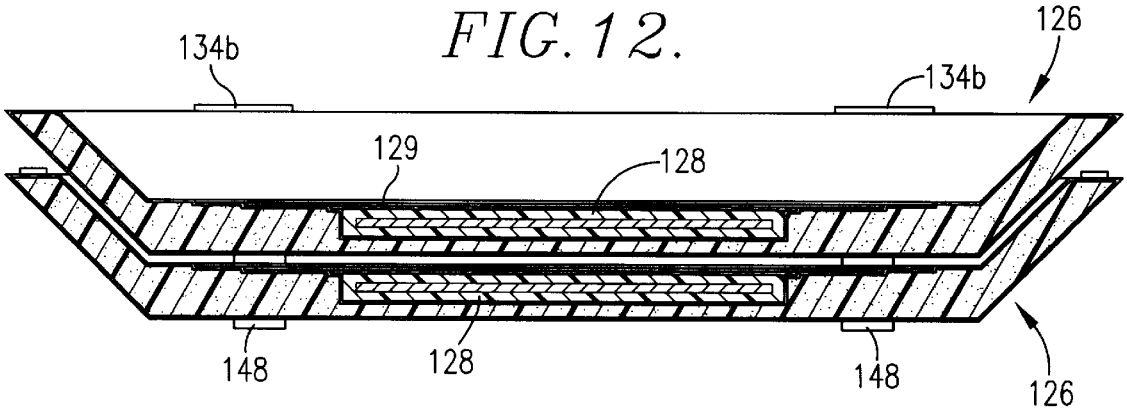
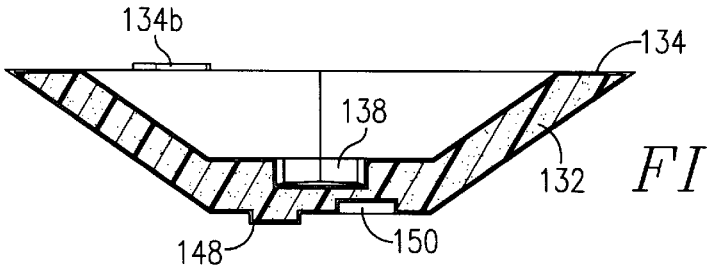
FIG. 13.

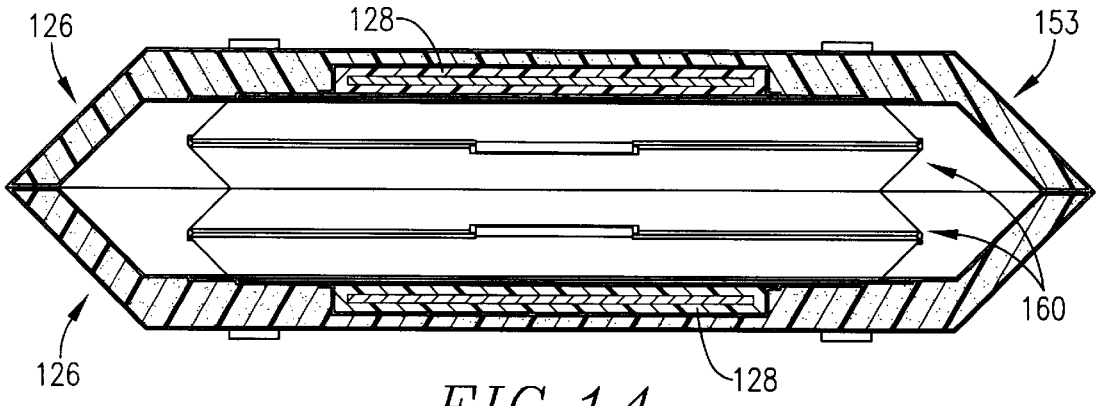
FIG. 14.
FIG. 15.
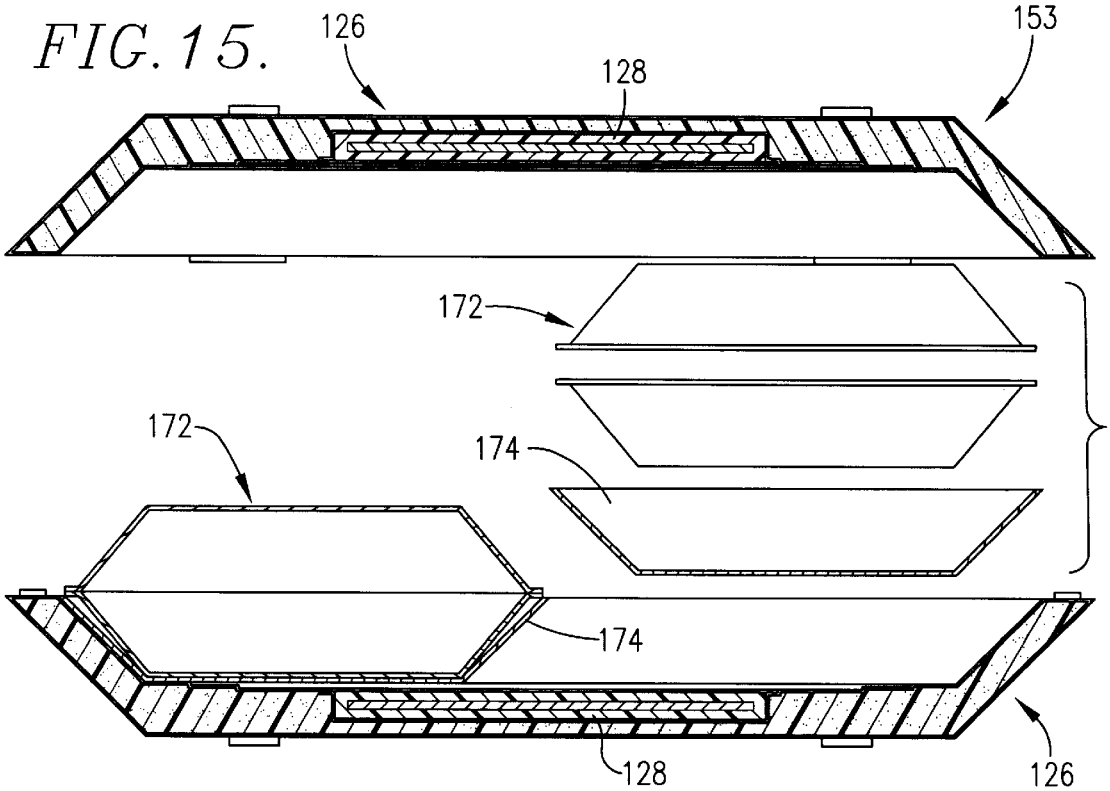
FIG. 16.
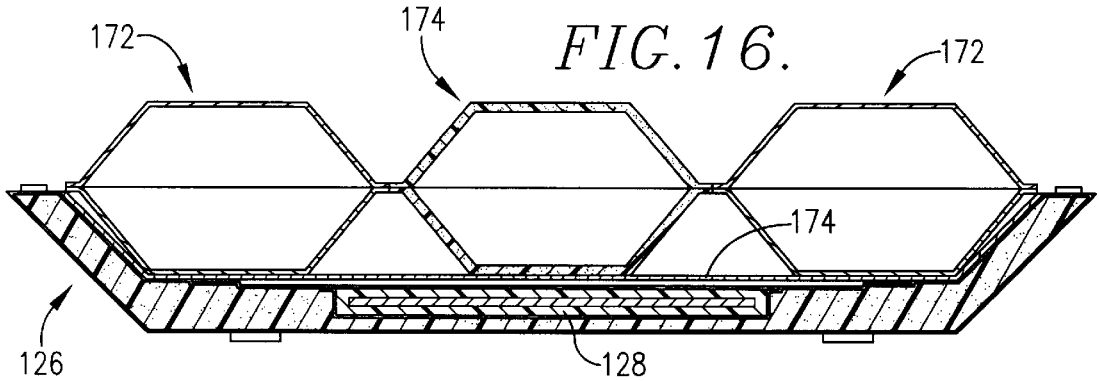

FIG. 18.
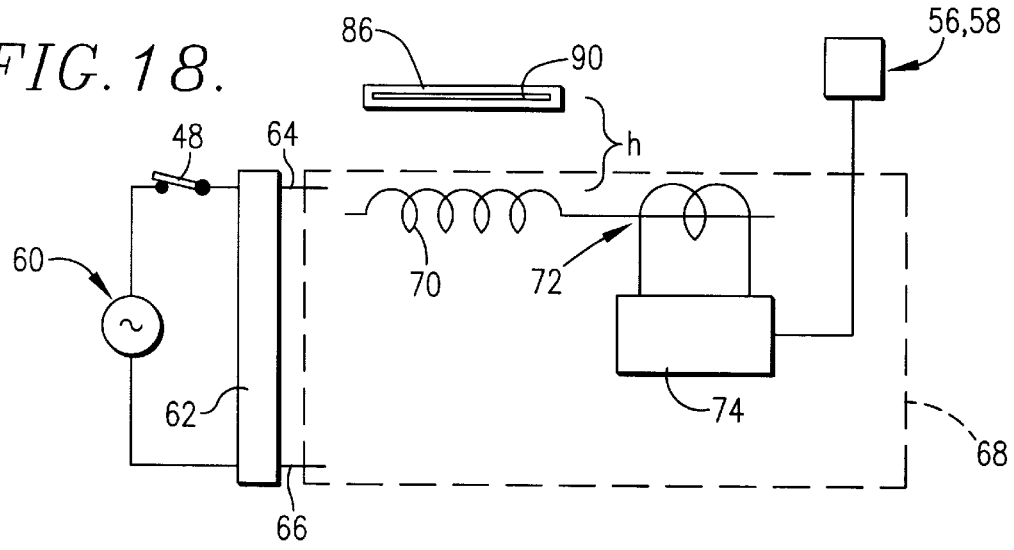
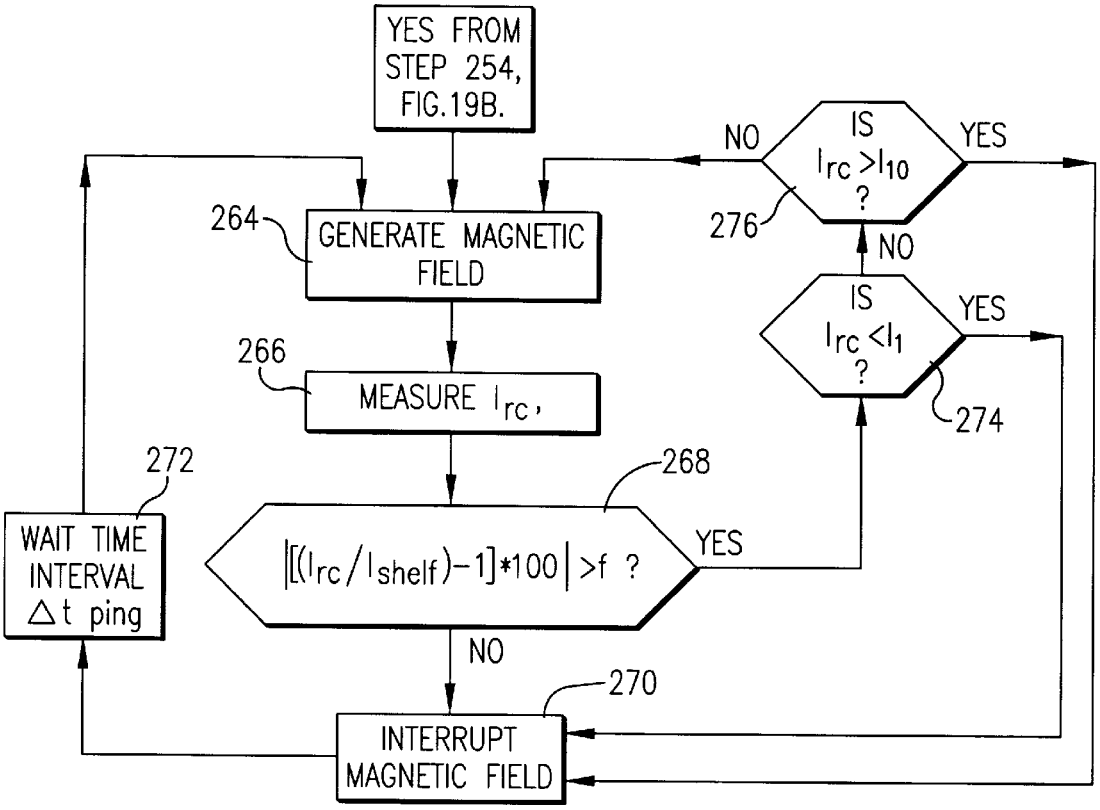
FIG. 20.

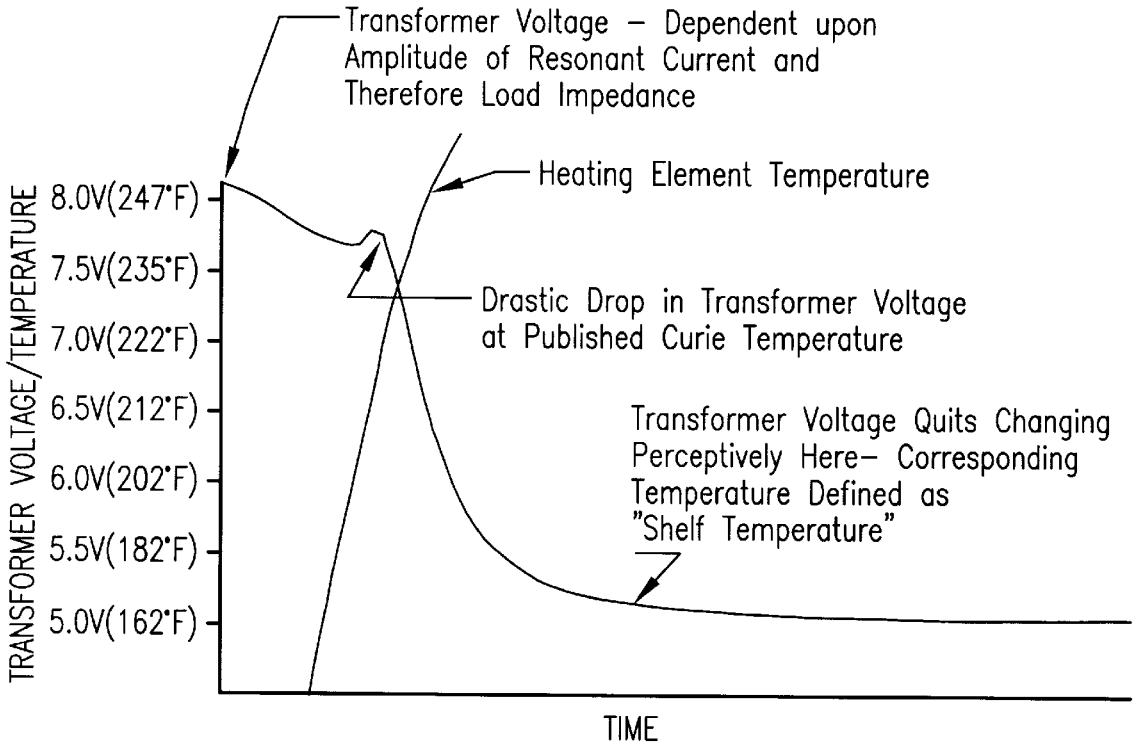
FIG. 21.
FIG. 22.
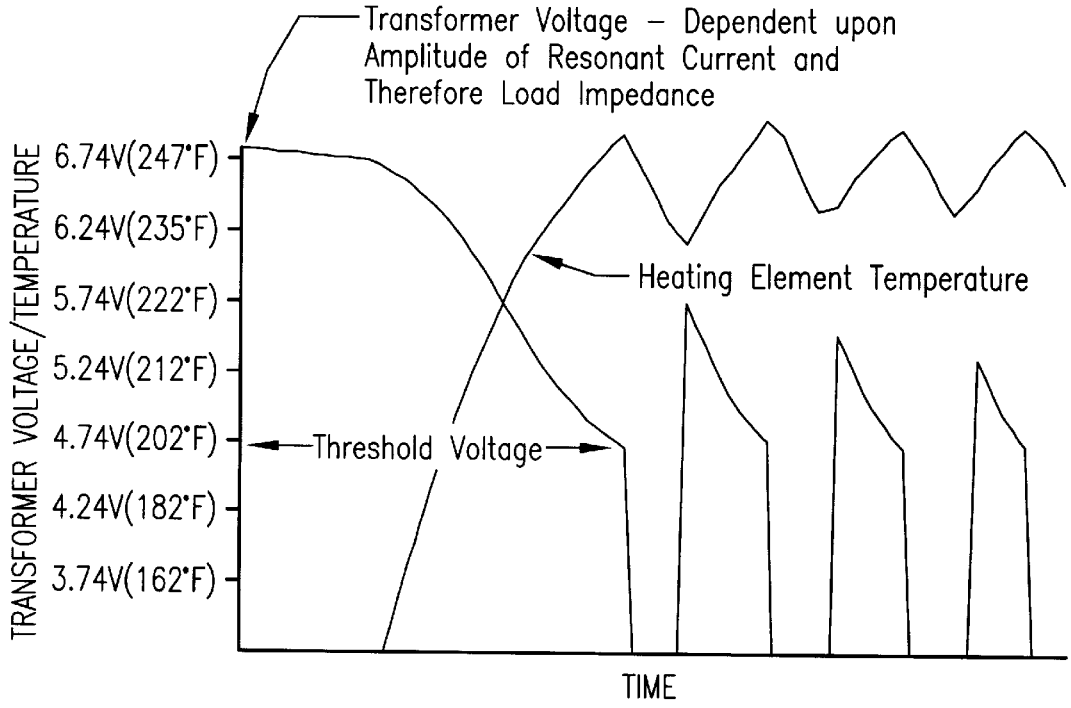

TEMPERATURE SELF-REGULATING FOOD DELIVERY SYSTEM

RELATED APPLICATION

This application claims the benefit of provisional patent application No. 60/086,033 filed May 19, 1998.

BACKGROUND OF THE INVENTION

1. Field of the Invention

The present invention is broadly concerned with food delivery systems designed to maintain food at a selected temperature over relatively long periods of time. More particularly, the invention pertains to such food delivery systems which include a magnetically heatable thermal storage device within a food-holding container, wherein the storage device may be selectively heated within said container by an induction charging station. In preferred forms, the charging station indefinitely maintains the selectively heated portion of the thermal storage device at a user-selected regulation temperature by using contact-less feedback from said device.

2. Description of Prior Art

The problems associated with the delivery of hot foods to consumers has in recent years taken on greater significance owing to the growth in convenience foods and those delivered directly to households. Although the rise in pizza deliveries is a prime example, other foods are now commonly delivered to the door, from simple hot sandwiches to complete meals.

For instance, most prior art pizza delivery systems consist simply of a partially insulated, non-sealing vinyl bag or sometimes a well-insulated nylon bag into which one or more cardboard boxes containing pizzas are placed so as to maintain the pizzas as warm as possible during delivery to the customer. Although the sauce layer of a freshly cooked pizza is typically over 200F., the sauce layer upon delivery is often as low as 110F., particularly where delivery times in excess of 30 minutes are experienced.

The problem of cold-delivered pizzas is only partly due to inefficient delivery bags and the like. In a typical pizza operation, once a pizza emerges from the oven it is removed and placed upon a cutting table to be sliced. The pizza is then placed in a cardboard box. Very commonly, two or more pizzas are to be delivered to the same address and multiple pizza bags full of pizzas are delivered to several different customers on the same delivery run. Under these circumstances, the boxed pizzas are placed under infrared heating lamps until all pizzas for a given run have been prepared, sliced and boxed. Due to the logistics involved in such operations, some pizzas can be almost cold before the delivery run even commences.

In 1998, Dominos Pizza introduced the Heat Wave™ pizza delivery system. This consists of an insulated nylon pizza bag, a wax-filled resistively heated plastic-coated thermal storage disk, and a rack charging system into which up to 20 thermal storage disks can be plugged so as to charge them with thermal energy. This system has several drawbacks. The thermal storage disks are heavy, weighing in excess of three pounds. Thus, the delivery container is no longer lightweight once the disk is in place. Furthermore, the disk requires a substantial time to become fully charged with thermal energy, taking over two hours from room temperature and over thirty minutes after a typical delivery to be fully charged. Additionally, the thermal storage disks must be plugged into and out of the charging rack, thus requiring the operator to perform additional steps. Finally, to implement the rack charging system, a typical pizza parlor must be substantially modified in terms of its power supply network and floor space to accommodate the rack.

There is accordingly a need in the art for an improved food storage and delivery system which will permit the purveyor to maintain the food products at or near a desired temperature over sustained periods, while also allowing delivery under conditions to substantially maintain this temperature. An effective hot food storage and delivery system thus requires a lightweight delivery container, a fast-charging thermal storage device capable of storing and efficiently releasing large amounts of thermal energy, and easy to operate equipment not requiring skilled labor.

SUMMARY OF THE INVENTION

The present invention overcomes the problems outlined above and provides a food delivery system broadly including a food delivery container equipped with a thermal storage device with the latter being heated while in the container by a magnetic induction charging station. Thus in the case of a pizza system, a flexible insulated bag or hard-sided container is equipped with a thermal storage device designed to remain within the bag throughout its operation. This thermal storage device includes a heat retentive pellet; the pellet has a ferromagnetic heating element which preferably is surrounded by synthetic resin heat retentive material. In order to charge the bag or container, it is simply placed upon a charging station including a magnetic induction coil and having temperature maintenance control circuitry that requires no connection to the bag or container; this serves to quickly heat the heat retentive pellet and to maintain it at a user-selected temperature without overheating. When a food item is prepared, it is placed within the bag or container for delivery. Temperature maintenance during delivery is assured because of the very significant thermal energy stored in the heat retentive pellet.

The preferred system of the invention employs a magnetic induction charging station, having a magnetic induction cooktop which is capable of infusing a vast amount of thermal energy into coupled heat retentive pellets in a very short amount of time. For instance, for pizza applications, it has been found that approximately 150,000 joules of thermal energy must be added to a room temperature pellet, and that the pellet should be brought to a surface temperature of around 230F. in less than about 4 minutes. The charging stations and heat retentive pellets of the invention can readily meet these demanding standards. Furthermore, the preferred charging station is capable of maintaining the pellet temperature indefinitely without any cords or other leads connecting the charging station and heating element, regardless of variations in thickness of the associated containers or other specific conditions of the containers. Finally, the charging stations of the invention are capable of charging a given heating element to the predetermined regulation temperature notwithstanding the initial temperature of the element, which will be variable over the course of several delivery runs and returns to the food preparation location.

The thermal storage devices of the invention are lightweight and ruggedly constructed so as to endure heating/cooling cycles. The pellets are able to withstand very fast charges and can release approximately 75,000 joules of energy during a 30 minute delivery cycle to the container contents for temperature maintenance. A particular advantage of the thermal storage devices is that they are sized to fit within standard pizza bags without modification thereof.

As indicated, the systems and methods of the invention utilize magnetic induction as an energy transfer means in order to charge heat retentive pellets coupled in a magnetic field. Moreover, the invention employs the concept of interrupting the continuous production of a magnetic field at user-selected regulation temperatures in order to heat the heating elements to a temperature and to maintain that temperature over time. To this end, various types of feedback parameters related to the impedance of the load presented to the magnetic induction cooktop by the heating element may be used to determine whether and when to interrupt the cooktop's magnetic field.

For example, the feedback parameter may be the amplitude of the resonant current flowing through the work coil of the induction cooktop, or alternately the absolute value of the rate of change of the resonant current amplitude over time. Most preferably however, periodic amplitude measurements of the current flowing through the work coil are taken and this raw data is used by the cooktop's microprocessor to periodically compute the absolute value of the rate of change of the resonant current amplitude. The microprocessor employs an algorithm that uses both the absolute value of the rate of change of resonant current amplitude and the exact value of resonant current amplitude to determine whether and when to interrupt continuous production of the magnetic field.

Thus a preferred method of the invention involves heating a ferromagnetic heating element by magnetically coupling the element with the magnetic field of a magnetic field generator, the latter having an induction work coil and a resonant circuit that includes the work coil. The improvement of the invention comprises the steps of controlling the temperature of the element about a regulation temperature above the element's Curie temperature by periodically determining at least two parameters of the resonant circuit related to the amplitude of the resonant current passing therethrough during element heating; in response to the determining step, the field strength of the magnetic field is altered when at least one of the parameters is above or below a selected value correlated with the regulation temperature. The parameters are advantageously the amplitude of work coil current during inverter on times and the rate of change of this current amplitude.

Although the method of the invention contemplates any kind of field altering, generally the magnetic field is fully interrupted when a parameter is above or below a selected value. Furthermore, the regulation temperature is normally above the Curie temperature of the heating element and between this Curie temperature and a "shelf temperature" defined herein.

BRIEF DESCRIPTION OF THE DRAWING FIGURES

FIG. 3 is an exploded perspective view with parts broken away depicting one preferred style of magnetically heatable thermal storage device;

FIG. 4 is a vertical sectional view of the thermal storage device illustrated in FIG. 3;

FIG. 5 is a perspective view of another preferred type of thermal storage device with the top removed and adapted to be used within an insulated pizza bag or the like, wherein a heat retentive pellet is surrounded by insulative material;

FIG. 6 is a sectional view depicting the thermal storage device structure of FIG. 5 disposed within a flexible insulated bag along with two boxed pizzas;

Figure 1:
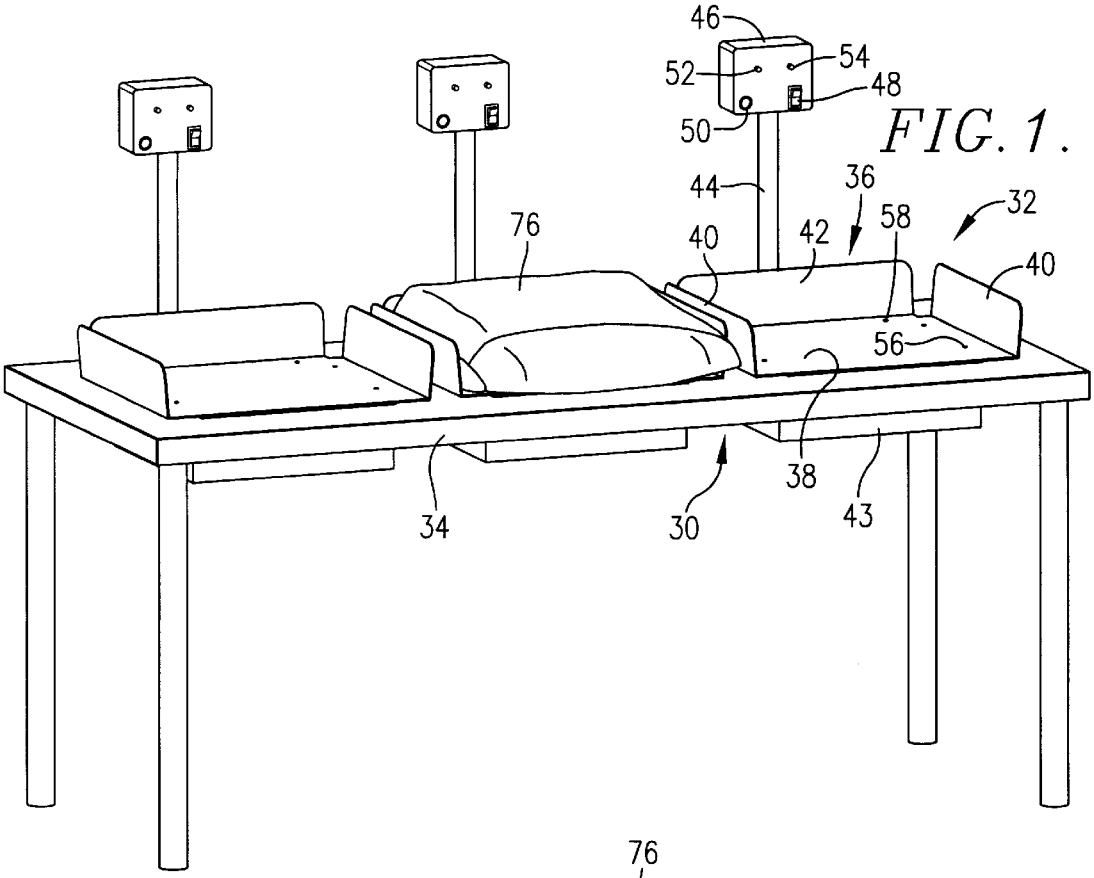
FIG. 1 is a perspective view of a table equipped with three individual magnetic induction charging stations.
Figure 7:
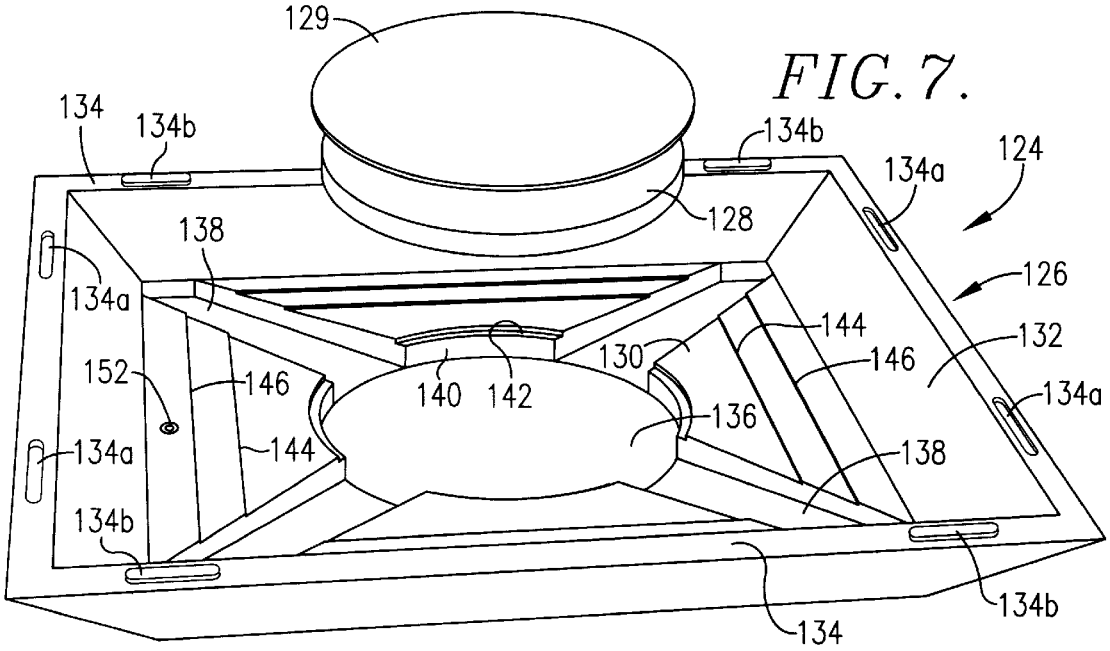
FIG. 7 is an exploded perspective view of one half of a symmetric food delivery device, made up of a two synthetic resin, preformed rigid body half-containers each having a heat retentive pellet.
Figure 8:
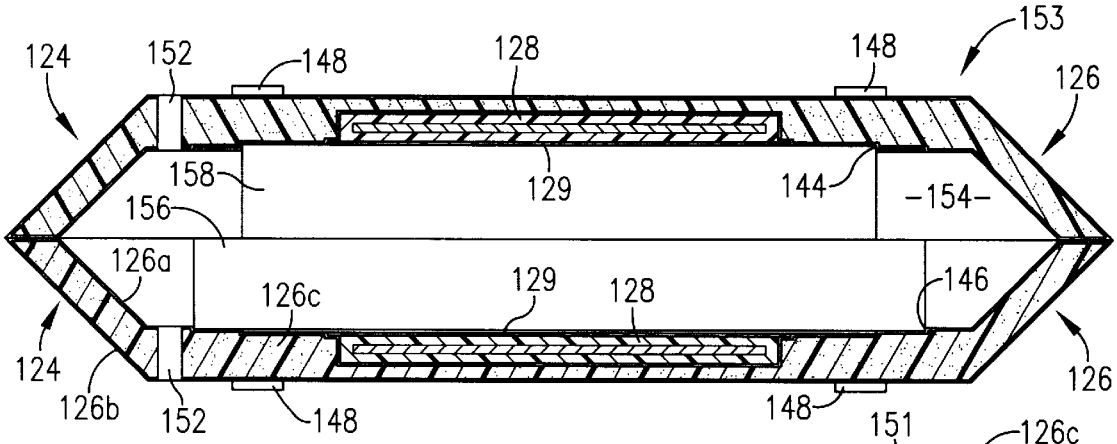
FIG. 8 is a vertical sectional view illustrating a pair of the preformed rigid body half-containers with pellets as illustrated in FIG. 7 in mating relationship to form a complete symmetric food delivery device, with a pair of boxed pizzas therein.
Figure 8A:
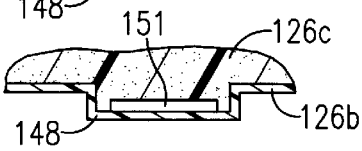
Figure 9:
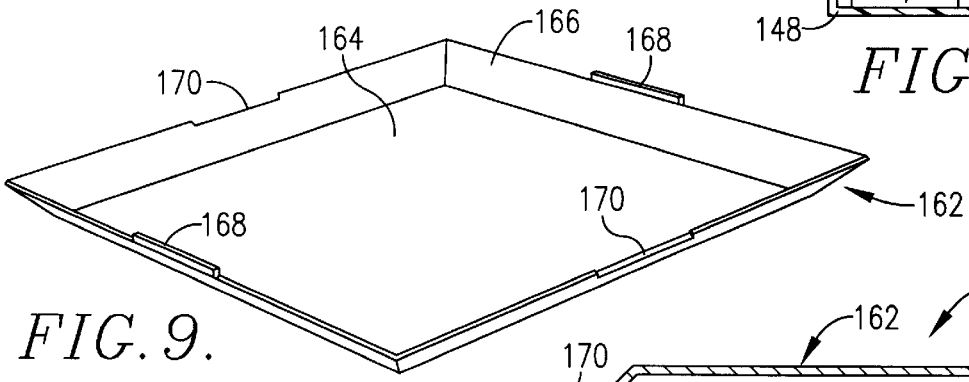
Figure 10:
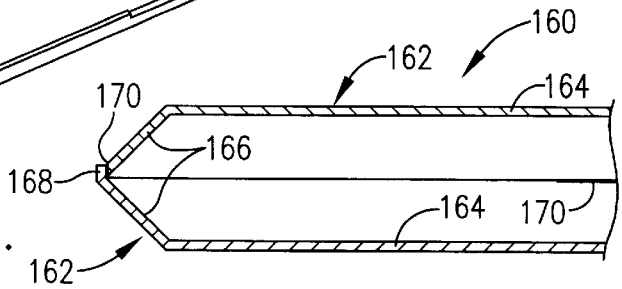
Figure 17:
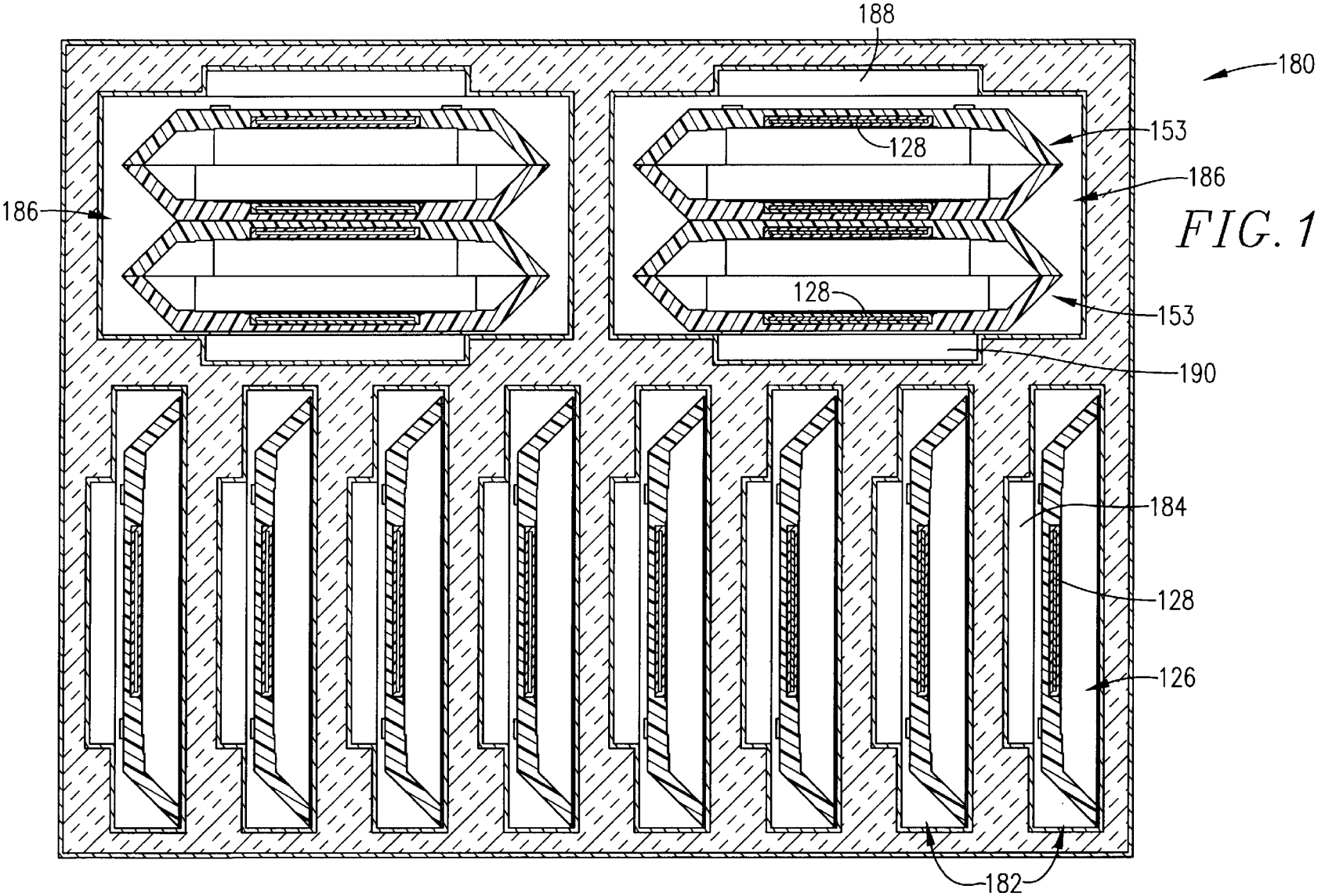
Figure 19A:
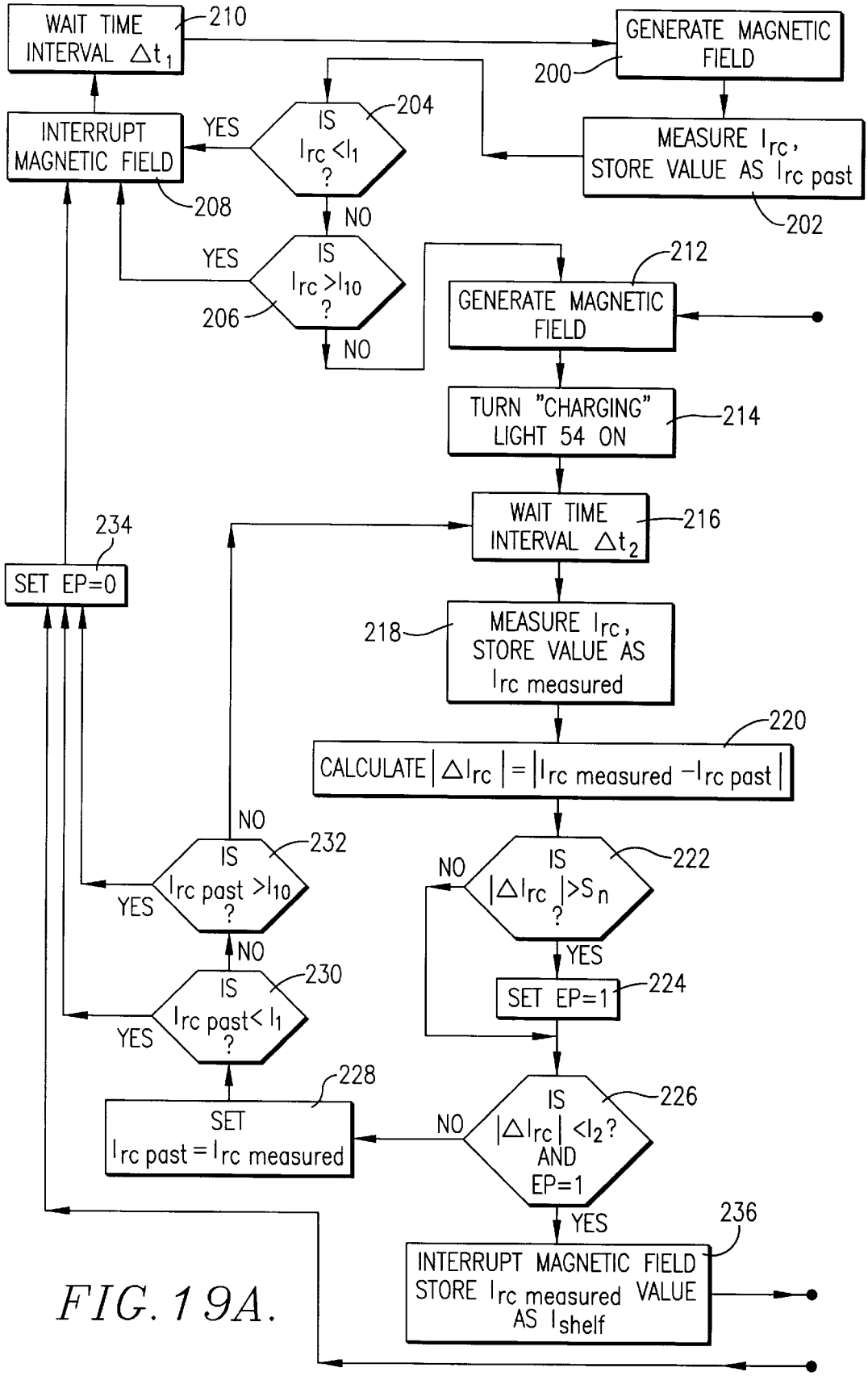
Figure 19B:
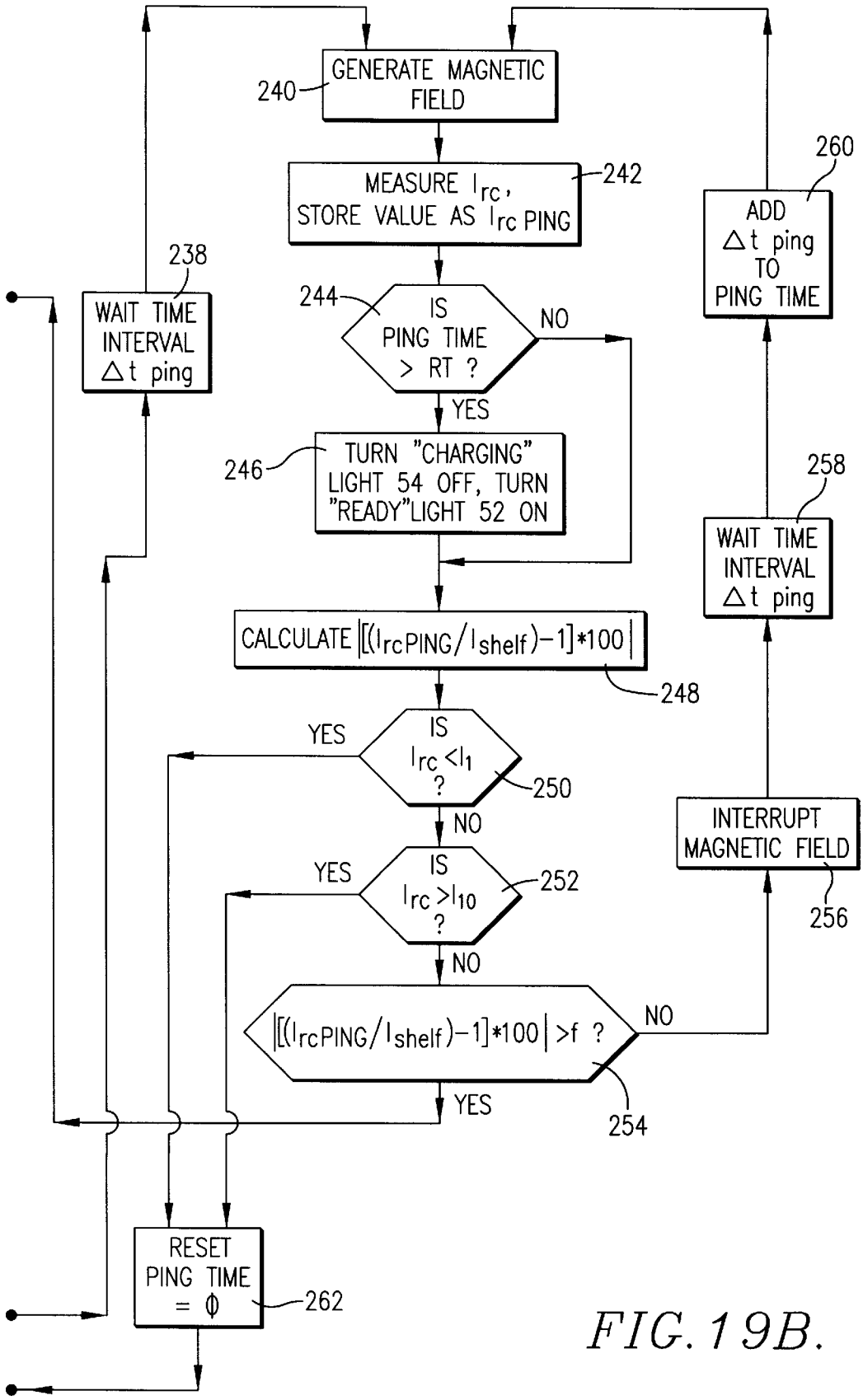
Figure 23:
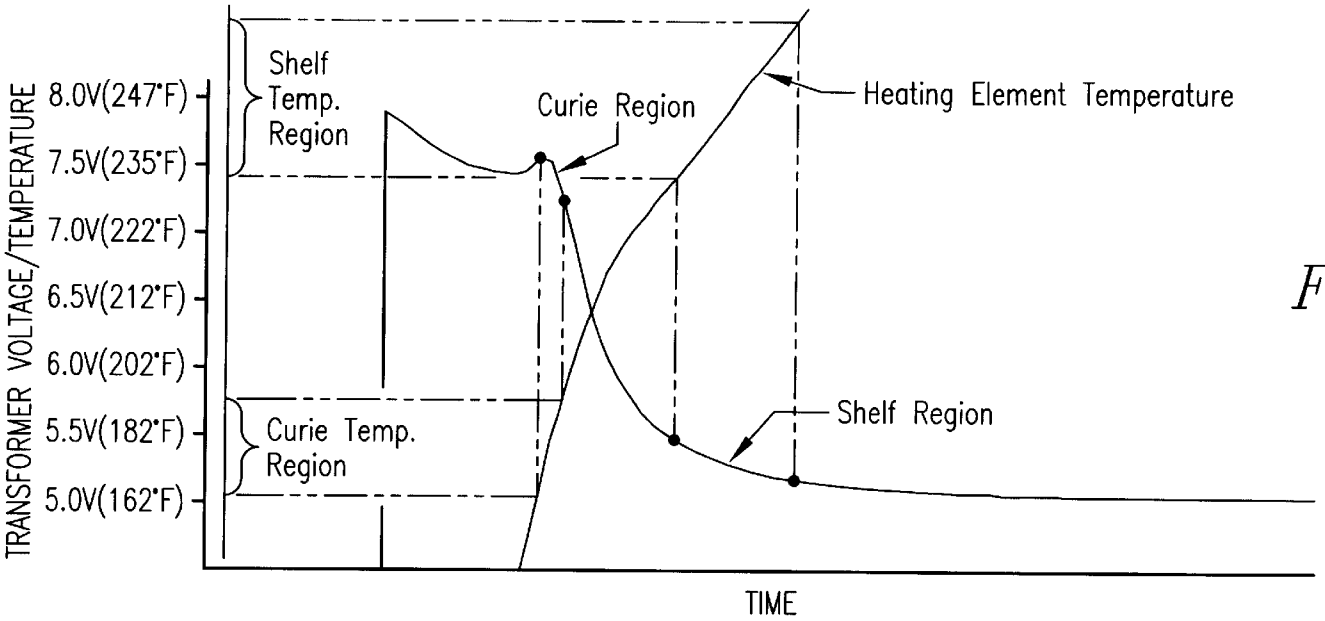
Figure 24:
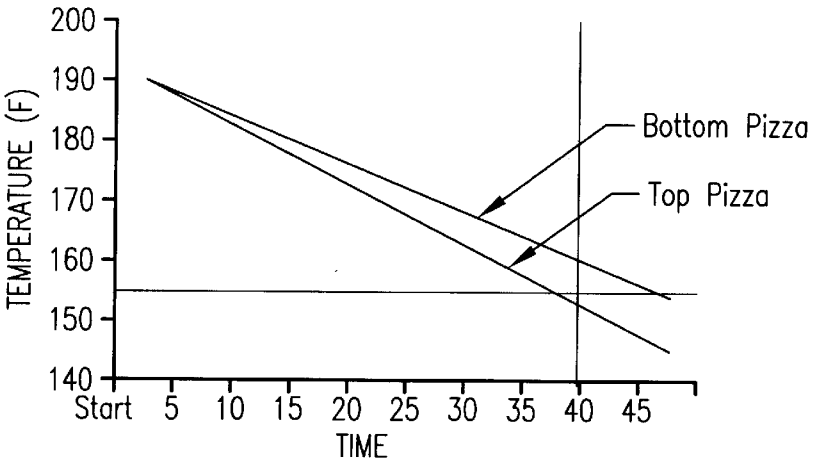

FIG. 8*a* is an enlarged fragmentary view illustrating a foot of one of the two preformed rigid body half-containers depicted in FIG. 8 and showing an RFID tag embedded in the foot;

FIG. 9 is a perspective view of a low-cost pizza half-box adapted to be used in conjunction with the food transfer devices of FIG. 8;

FIG. 10 is a fragmentary vertical sectional view illustrating a pair of the half-boxes of FIG. 9, shown in mating relationship to form a closed low-cost pizza box;

FIG. 11 is a plan view of the outside surface of the preformed rigid body half-container of FIG. 7;

FIG. 12 is a vertical sectional view illustrating a pair of the preformed rigid body half-containers with pellets of FIG. 7 in nested relationship, in further depicting the details of construction thereof;

FIG. 13 is a sectional view taken along line 13—13 of FIG. 11;

FIG. 14 is vertical sectional view illustrating a pair of the preformed rigid body half-containers with pellets of FIG. 7 in opposed, mating relationship to define a symmetric food transfer device, with a pair of the low-cost pizza boxes of FIGS. 9–10 situated within the closed cavity of the food transfer device;

FIG. 15 is an exploded view in partial vertical section showing a pair of the preformed rigid body half-containers with pellets of FIG. 7, with liners and different types of inner food-holding containers between them;

FIG. 16 is vertical sectional view illustrating one of preformed rigid body half-containers with pellet of FIG. 7, shown with a preformed liner and with different types of inner food-holding containers therein;

FIG. 17 illustrates a multiple-bay holding and charging station for the preformed rigid body half-containers with pellets of FIG. 7 and for the symmetric food transfer devices of FIG. 8;

FIG. 18 is a schematic block-type diagram of circuitry typically forming a part of the charging stations of FIG. 1;

FIG. 19 (separated as FIGS. 19A and 19B owing to space considerations) is a flow chart describing one preferred temperature regulation method employed in the charging stations of the invention, wherein the regulation temperature is essentially equal to the shelf temperature of a ferromagnetic heat element;

FIG. 20 is a flow chart describing an improvement which may be employed with the FIGS. 19A and 19B method to allow temperature regulation at selected temperatures between the Curie and shelf temperatures of a ferromagnetic heating element;

FIG. 21 is a graph illustrating both the transformer voltage proportional to resonant circuit current amplitude of a commercial cooktop and corresponding temperature of a solid-sheet nickel/copper heating element heated thereon versus time;

FIG. 22 is a graph illustrating both the transformer voltage proportional to resonant circuit current amplitude of a commercial cooktop and corresponding temperature of a solid-sheet nickel/copper heating element heated thereon versus time wherein the magnetic field was interrupted to achieve temperature regulation;

FIG. 23 is a graph illustrating both the transformer voltage proportional to resonant circuit current amplitude of a commercial cooktop and corresponding temperature of a solid-sheet nickel/copper heating element heated thereon versus time whereon two regions of the transformer voltage corresponding to temperatures immediately about the known Curie temperature and temperatures immediately about the shelf temperature have been highlighted; and FIG. 24 is a graph illustrating the temperature decrease over time using two commercially available pizzas heated using the preferred system of the invention.

DETAILED DESCRIPTION OF THE PREFERRED EMBODIMENTS

The present invention provides a food delivery system broadly comprising a food delivery container, a thermal storage device intended to release thermal energy to the food within the delivery container and a means to infuse or charge the storage device with thermal energy so as to maintain the temperature of the food during transport. As explained above, one type of food item requiring temperature maintenance during delivery is pizza, and accordingly certain embodiments of the invention are specific to this problem. However, it should be understood that the invention is not limited to pizza temperature maintenance, but rather relates to any type of food delivery system for virtually all food items which require or may be rendered more palatable by temperature maintenance.

FIG. 1 illustrates a table 30 equipped with three laterally spaced apart magnetic induction charging stations 32. The top 34 of table 30 has three spaced openings therein, to accommodate the respective stations 32. Each of the latter are identical, and include an upright, open-front, polycarbonate locator/holder 36 equipped with a base plate 38, upstanding sidewalls 40, and back wall 42. Each such station 32 has a magnetic induction cooktop 43 directly below and connected with the base plate 38 of a locator/holder 36, as well as a flexible conduit 44 connecting the cooktop to a status indicator box 46. The box 46 has an on-off power switch 48, reset button 50, and a "ready" indicator light 52 and a "charging" indicator light 54. A pair of spaced apart photo sensors 56, 58 are positioned within base plate 38. Although not shown in FIG. 1, the indicator box 46 may also include a regulation temperature readout and input device allowing a user to select a desired regulation temperature within a given range.

Each cooktop 43 is preferably a CookTek Model CD-1800 magnetic induction cooktop having its standard ceramic top removed and connected to a locator/holder 36. The microprocessor of the cooktop is programed so as to control the circuit in accordance with the preferred temperature control method of the invention as illustrated in the flow chart of FIGS. 19A and 19B described in more detail below. FIG. 18 depicts in block schematic form the circuitry of the cooktop 43. Thus, a commercial power supply 60 (preferably a standard 120V power outlet) is operably connected to an output switch 48. A full wave rectifier and filtering network 62 is coupled with the switch 48 and supplies a filtered, full wave rectified unidirectional excitation potential across bus lines 64, 66 for use by an oscillation and inverter circuit 68. The circuit 68 comprises primarily an induction coil 70, resonant capacitor(s), switching transistors, means for providing stable oscillation, sensing transformer coil 72 and microprocessor control circuit 74. As illustrated, photo sensors 56, 58 are operably connected as an input to circuit 74. The cooktop 43 is designed to produce an alternating magnetic field in the preferred range of 20–100 kHz. It will be understood that FIG. 18 represents a generalized description of well known magnetic induction cooktops, such as the CookTech Model CD-1800; however, a variety of other commercial available cooktops of this type can be used. Also, more detailed descriptions of magnetic induction cooktop circuitry can be found in U.S. Pat. Nos. 4,555,608 and 3,978,307, which are incorporated by reference herein.

In use, a ferromagnetic heating element 90 inside a heat retentive pellet 86 will be placed upon the cooktop adjacent work coil 70, and will be separated therefrom by a distance h. This distance h may vary depending upon the construction of the particular food container and the design of the heat retentive pellet 86.

Photo sensors 56, 58 are coupled with the microprocessor circuitry control 74 of the cooktop and serve as a sensor for determining when a food delivery container of this invention is located on cooktop 43. When such a food delivery container is placed upon the cooktop 43, the photo sensors 56, 58 will send an initiation signal to the microprocessor allowing it to initiate the heating operation. It will be understood that a variety of different sensors can be used in this context, so long as the sensors can discriminate between an appropriate food container/ferromagnetic heating element and another type of object which may be improperly or inadvertently placed upon the cooktop. The simplest such sensor would be a mechanical switch or several switches in series so placed on the base plate 38 so that only the proper food delivery containers would activate the switch or switches. Other switches such as proximity switches or light sensor switches (photosensors) could be substituted for press-type switches.

A more advanced locating sensor would make use of Radio Frequency Identification (RFID) technology. RFID is similar to barcode technology, but uses radio frequency instead of optical signals. An RFID system consists of two major components, a reader and a special tag or card. In the context of the present invention, the reader would be positioned adjacent the base plate 38 in lieu of or in addition to the photo sensors 56, 58, whereas the corresponding tags would be associated with the food containers. The reader performs several functions, one of which is to produce a low level radio frequency magnetic field, usually at 125 kHz or 13.56 MHz, through a coil-type transmitting antenna. The corresponding RFID tags also contain a coil antenna and an integrated circuit. When the tag receives the magnetic field energy of the reader, it transmits programmed memory information in the IC to the reader, which then validates the signal, decodes the data, and transmits the data to an output device.

RFID technology has many advantages in the present invention. The RFID tag may be several inches away from the reader and still communicate with the reader. Furthermore, many RFID tags are read-write tags and many readers are readers-writers. The memory contents of the read-write tags may be changed at will by signals sent from the reader-writer. Thus, a reader (e.g., the OMR-705+ produced by Motorola) would have its output connected to the cooktop's microprocessor, and would have its antenna positioned beneath the base 38. Each corresponding food container includes an RFID tag (e.g., Motorola's IT-254E). When a food container with an attached tag is placed upon the locator/holder 36, the communication between the container tag and the cooktop reader generates an initiation signal permitting commencement of the heating cycle. Another type of object not including an RFID tag placed on the cooktop would not initiate any heating.

Figure 2:
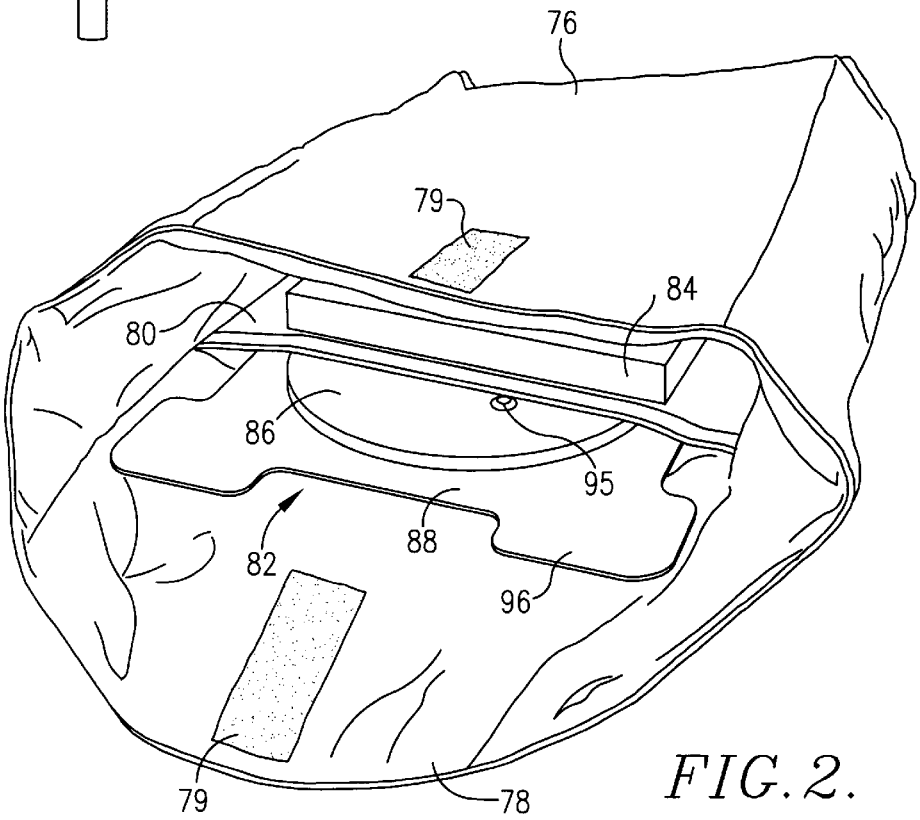
FIG. 2 is a perspective view illustrating an insulated pizza delivery bag having therein a magnetically heatable thermal storage device, with a boxed pizza in the bag adjacent the heat retentive pellet.

As depicted in FIG. 1, each of the locator/holders 36 is adapted to receive a flexible insulated pizza delivery bag 76, in order to infuse thermal energy into a thermal storage device therein. Referring to FIG. 2, it will be seen that such a bag 76 has a closure flap 78 (closable by attaching mating Velcro strips 79 on the flap and bag) as well as an internal, non-insulated nylon pocket 80. The pocket 80 is designed to essentially permanently receive therein a thermal storage device broadly referred to by the numeral 82, with one or more boxed pizzas 84 located atop pocket 80 and within the confines of the bag. Referring to FIGS. 3 and 4, the thermal storage device 82 is illustrated in more detail. The device 82 includes a circular, plate-like, heat retentive pellet 86 and a base 88. The pellet 86 is preferably composed of an internal metallic magnetic induction heating element 90 surrounded by synthetic resin heat retentive material 92.

As indicated previously, the bag 76 would be sized so that when placed upon the cooktop 43, the photo sensors 56, 58 would sense its presence and send a heating cycle initiation signal to the cooktop's microprocessor. In the case of RFID technology, the bag 76 would include an RFID tag which would be read by a cooktop-mounted RFID reader.

The element 90 can have a wide variety of compositions, forms and shapes, but preferably is composed of a nickel/copper alloy whose nickel content is above about 70% by weight; the exact nickel percentage is dictated by the desired Curie temperature of the element 90. As illustrated, the preferred element 90 is preferably a solid sheet of the selected nickel/copper alloy formed as a thin, circular disk typically having a thickness of about 0.035 inches. If desired, a plurality of holes may be drilled or punched through the disk to allow flow of heat retentive material during manufacture of the pellet.

The presently preferred element 90 for use in pizza temperature maintenance is a 0.036 inch thick solid sheet of 78% nickel/22% copper alloy with minimal trace element impurities. The sheet is cut into a 9.75 inch diameter disc. The disc has one center hole and five evenly spaced holes located along a 2.5 inch radius from the center.

The heat retentive material 92 is preferably a solid state phase change material formed of a mixture of polyethylene, structural additives, thermal conductivity additives, and antioxidants that has been radiation crosslinked after the entire pellet has been molded. In the form shown in FIG. 2, the upper surface of material 92 has molded elongated ribs 94. Normally, at least about 70% by weight of the heat retentive material is selected from the family of polyethylene resins. Many factors well known in the prior art are used to choose the exact polyethylene resin used for a suitable thermal storage material: the density, percent crystalinity, melt index, molecular weight distribution, types of monomers making up the polyethylene molecules, catalyst used, processing method, processing additives blended into the resin, antioxidants blended into the resin packages, and others. References such as "Radiation Chemistry of Macromolecules", M. Dole, Academic Press, New York, 1972 and journal articles such as "Cyrstalline Polymers as Heat Storage Materials in Passive Thermal Protection Systems", *Polymer Engineering and Science,* Vol. 15, No. 9, 1975, pp. 673–678 (incorporated by reference herein) may be consulted for guidance regarding particular heat retentive materials.

Since the exact temperature at which latent heat will be stored and later released is primarily a function of the polyethylene density, such density often becomes a primary design factor for choosing the optimum resin for a pellet of this invention. For instance, because the latent heat storage temperature for a pizza delivery application requires a latent heat storage temperature of approximately 230F., the types of resins capable of providing a phase change in this region are usually low density polyethylenes and linear low density polyethylenes. For pizza delivery applications the preferred resins are: (1) a linear low density polyethylene resin designated as GA 564 from Equistar Chemicals, LP of Houston, Tex.; (2) a metallocine linear low density resin from Phillips Petroleum Company of Houston, Tex. designated as mPact D139; and (3) a low density polyethylene resin designated as LDPE 640I from Dow Plastics of Midland, Mich. All three resins are FDA approved for food contact use.

Since various food delivery applications of this invention may require different latent heat storage temperatures, other polyethylene resins may be chosen for the corresponding pellets. The family of polyethylene resins have available latent heat storage temperatures ranging from between approximately 190F. to approximately 290F., corresponding to specific densities from approximately 0.915 to approximately 0.970. Furthermore, within each of these density ranges, many polyethylene resins that are FDA approved for food contact use may be found.

Prior to radiation crosslinking, the chosen resin may have antioxidants added thereto to deter oxidation of the heat retentive material during its life of periodic exposure to temperatures in excess of its crystalline melting temperature. Many antioxidants known in the prior art such as Hindered Phenols, Hindered Amine Light Stablizers (HALS), phosphite antioxidants, and other may be used. Particularly, antioxidants such as Irganox$^R$ 1010 or Irganox$^R$ 1330 produced by Ciba Specialty Chemicals of Switzerland, Uvasil$^R$ 2000 LM produced by Great Lakes Chemical Corporation of West Lafayette, Ind., Ultranox$^R$ 641 and Weston$^R$ 618 produced by GE Specialty Chemicals of Parkersburg, W. Va., and Doverphos$^R$ S-9228 produced by Dover Chemical Corp. of Dover, Ohio are preferred. Experimentation has shown that HALS provide the best balance of antioxidant protection and decreased crosslinking efficiency. Whatever the anitoxidant used, care should be taken to ensure that the total level of each antioxidant used within the heat retentive material conforms with applicable standards for food contact use. Typically, this means antioxidant additions to resin ranging from 0.05% to 1.0% by weight. Furthermore, the cumulative total of antioxidant used must conform to such standards. These additional antioxidants are blended into the resin by means known in the art, such as by compounding.

Structural and/or thermal conductivity materials may also be added to the resin formulation. Particularly, chopped glass fiber, glass particles, and FDA approved carbon powders may be used. Chopped glass fiber at up to 30% by weight addition adds great structural strength to a heat retentive pellet that is heated above the melting point of the polyethylene resin. Chopped glass fiber, such as 415A CRATEC$^R$ Chopped Strands, is particularly formulated to optimize glass/polymer adhesion and may be added to the resin by means known in the art such as compounding.

Experimental resins incorporating carbon powder such as MPC Channel Black produced by Keystone Aniline Corporation of Chicago, Ill. and XPB-090 produced by Degussa Chemicals of Akron, Ohio as additives to LDPE and LLDPE resins demonstrate that they not only improve structural integrity at high temperatures and improve thermal conductivity of the mixture, but that they also reduce the oxidation rate of the polyethylene. A test sample composed of 23% by weight Keystone MPC Channel Black and 77% by weight Equistar GA 564 resin with no additional additives, electron beam crosslinked to a total absorbed dose of 15 Mrad was found to show no signs of oxidation after 150 hours in a circulating air oven at 300F. This performance was a substantial improvement over that of a identical sample composed of 100% Equistar GA 564 resin with no additional additives, identically crosslinked, and subjected to the same conditions.

Once the resin and any of the above-described additives are chosen and compounded, the mixture is preferably injection molded around the magnetic induction heating element via an insert molding technique. Other production methods known in the art such as compression molding may also be used.

After the pellet has been molded it is radiation crosslinked. Radiation crosslinking of polyethylenes and polyethylene-based composite materials is well known in the art. Companies such as E-BEAM Services, Inc. with plants in Cranbury, N.J., Plainview, N.Y., Lafayette, Ind., and Cincinnati, Ohio irradiate thousands of pounds of polyethylene annually with electron beams for use as high temperature wire and cable sheathing, shrink tape and tubing, among others. Furthermore, many companies also crosslink polyethylene with gamma radiation at treatment facilities across the nation. While electron beam crosslinking is the preferred crosslinking method for this invention, gamma radiation is also suitable. Both radiation methods produce no toxic byproducts within the pellet and radiation crosslinked polyethylene is FDA approved for food contact use.

Regardless of the source of radiation, the primary benefit of radiation crosslinking the heat retentive material 92 of the pellet of this invention is to ensure that it remains in the solid state when heated well above the melting temperature of the polyethylene. Thus, a magnetic induction heating element 90 encased in the preferred heat retentive material 92 may be quickly heated to a temperature well above the melting temperature of the non-crosslinked resin and remain there indefinitely, all the while storing both sensible and latent heat in a pellet that remains solid.

Tests have shown that a radiation doses between 10 Mrad and 20 Mrad, mixtures of 70% by weight or more of any of the above-mentioned resins combined with 30% by weight or less of glass and/or carbon powder fillers achieve enough gel percentage to be suitable solid-to-solid phase change heat retentive material for purposes of the invention. Furthermore, tests have shown that the latent heat per gram of the crosslinked resin is substantially retained. Thus, latent heat storage of from approximately 20 cal/g to approximately 50 cal/g may be achieved, depending upon the crystallinity of resin chosen. The addition of extra antioxidants to the resin/filler mixtures requires a higher total radiation dose to achieve the same gel percentage but does not affect the latent heat storage per gram of the resin itself.

In summary, a preferred heat retentive material 92 is radiation crosslinked, solid-to-solid phase change composite having at least about 70% by weight polyethylene content and from 0% up to about 30% by weight of additives such as antioxidants, thermal conductivity additives, structural additives, or other additives.

One preferred pellet for pizza temperature maintenance using flexible insulated pizza delivery bag 76 is formed of a mixture of 70% by weight Equistar GA 564 LLDPE resin and 30% by weight chopped glass fiber, such as 415A CRATEC$^R$ Chopped Strands available from Owens Corning, that is injection molded around the element 90 using insert molding techniques to form a 10.0 inch diameter by 0.434 inch thick disk-shaped pellet weighing 1.8 pounds. Once molded, the pellet is electron crosslinked using a 2.0 MeV electron beam to achieve a total absorbed dose of 20 Mrad on each side of the pellet. It has been found in production that the magnetic induction heating element prevents adequate penetration of low energy electrons to evenly crosslink both sides of the pellet from a single side bombardment. The ribs 94 are used to provide a buffering air space between the pellets main surface area and any other object coming into contact with the pellet. Aluminum rivets 95 (see FIG. 2) are employed to connected the pellet 86 to base 88.

For food delivery applications that do not require a pellet with latent heat storage ability, a non-toxic thermoplastic material with a high melting temperature and a high specific heat may also be used alone or in composite form with the additives described above, formed around a ferromagnetic core such as the element 90. Suitable thermoplastic materials should have melting temperatures, and preferably continuous use temperatures, well above the desired regulation temperature of the pellet for a given food delivery application. For instance, for the pizza delivery application, the thermoplastic material should have a continuous use temperature above about 230F. Furthermore, suitable thermoplastic materials should have high specific heats, preferably above 0.3 cal/g, so as to be able to store sufficient thermal energy to achieve the food delivery system goals.

Nylons, polyethylenes, polypropylenes, and thermoplastic polyesters are especially suitable. Furthermore, other engineering plastics known in the art may be used. The chosen materials should allow for either injection molding or compression molding of the pellet.

One preferred non-phase change pellet for pizza temperature maintenance within the flexible insulated pizza delivery bag 76 is formed of 30% glass filled nylon injection molded around the element 90 using insert molding techniques to form a 10.0 inch diameter by 0.434 inch thick disk-shaped pellet weighing 1.8 pounds. The ribs 94 are used to provide a buffering air space between the pellets main surface area and any other object coming into contact with the pellet. Aluminum rivets 95 (see FIG. 2) are employed to connected the pellet 86 to base 88.

In summary, such non-phase change pellets are generally composites formed about a ferromagnetic core and having at least about 70% by weight thermoplastic resin and from 0% up to about 30% by weight of antioxidants, thermal conductivity additives, structural additives, or other additives that will remain solid throughout the heating/cooling cycle of the pellet.

Optionally, the heat retentive pellets of the invention may be encapsulated using a shell or coating which may act as a passive oxygen barrier so as to slow the oxidation rate of the crosslinked synthetic resin material, thus prolonging the useful life of the pellets. Many materials are known which may serve as an oxygen barrier. However, two specific coating materials and their associated deposition methods are preferred. First, the coating or shell may be formed of diamond-like carbon (DLC) coating material. DLC is a highly ordered conformal carbon coating that is applied by plasma-enhanced chemical vapor deposition under vacuum under substrate temperatures less than 150C., thus making it suitable for a thin encapsulating shell for the pellets hereof. Studies with plastic beer bottles have shown that DLC can improve the oxygen barrier properties of a plastic substrate by 500 to 1000%. Companies such as Diamonex, Inc. of Allentown, Pa. and other supply DLC coatings. Another preferred coating is parylene, which is a conformal pinhole-free protective polymer coating that is applied at the molecular level by a vacuum deposition process at ambient temperatures. Film coatings from 0.1 to 76 microns can easily be applied in a single operation. Parylene C has a low oxygen permeability and thus makes an excellent passive oxygen barrier. Specialty Coating Systems, Inc. of Indianapolis, Ind. applies parylene coatings. Other suitable encapsulating coatings can be used to act as moisture barriers as well as passive oxygen barriers.

The base 88 is a synthetic resin (phenolic, nylon, or other high temperature composite material) plate having bifurcated ends 96 and 98. Any suitable material may be used in the fabrication of the base so long as it provides sufficient rigidity and support for the pellet 86. The base 88 provides a flat rigid bottom to the pizza bag 76 and thus keeps the insulation in the bag from bunching up. It also functions to provide an insulating layer between the pellet 86 and the bottom panel of the pizza bag. However, the primary function of the base 88 is to locate the pellet 86 directly over the coil of one of the charging stations 32.

FIGS. 5 and 6 illustrate another thermal storage device embodiment in accordance with the invention, namely thermal storage device 100. Broadly, this embodiment includes a heat retentive pellet 86 having any of the above-described constructions housed within a casing structure 102 that includes thermal insulation 104. In detail, it will be observed that the casing structure 102 includes a unitary, open top tray 106 having a bottom wall 108 and upstanding sidewalls 110. A laminated base plate 112 is positioned on the bottom wall 108 and is adhered thereto by silicone adhesive. The plate 112 is formed of a synthetic resin corrugate sheet 114, supporting a thin metallized film 116; polyester, polypropylene, polyvinyl flouride, polyvinyl chloride, or other thin insulating film that has been coated with a thin layer of metal by vapor deposition, sputtering, or other coating methods known in the art. The sheet 114 functions to reduce conductive heat losses from the pellet to the tray bottom. A piece of low emissivity, metallized film 116 (e.g., NRC-2/500 from Metallized Products of Winchester, Mass.) is adhered by silicone adhesives to the sheet 114 and serves to reflect infrared radiation from the pellet away from the bottom of the box while not interfering with the magnetic field created during charging. Tests have shown that NRC-2/500 film reduces the peak temperature of the bottom wall over a normal 30 minute pizza delivery as well as aluminum foil yet does not prevent the pellet from being temperature regulated via the preferred method of this invention. A series of upright 0.5" diameter×0.25" thick nylon washers 118 are secured to the film 116 by adhesive and support the pellet 86. Foam insulation 104 is situated within the confines of the tray 106 and has a central opening 120; the insulation 104 is maintained in place by silicone adhesive. As best seen in FIG. 6, the pellet 86 is positioned atop the washers 118, with the insulation 104 in surrounding relationship thereto. A removable top 122 formed of nylon is snapped into place on the tray 106 such that it makes thermal contact with the pellet 86; this completes the assembly of thermal storage device 100. Again as seen in FIG. 6, the assembly 100 is sized to fit within bag 76, and is operable to support one or more boxed pizzas 84. If desired, mating Velcro patches on the bottom of the tray 106 and the interior of the pizza bag 76 may be used to hold the assembly 100 in place.

The preferred pellet 86 of this embodiment employs a heat retentive material is composed of a blend of a 23% by weight Keystone MPC Channel Black and 77% by weight Equistar GA 564 resin with no additional additives. Once molded, the pellet is electron crosslinked using a 2.0 MeV beam to achieve a total absorbed dose of 15 Mrad on each side of the pellet. It has been found in production that the magnetic induction heating element prevents adequate penetration of low energy electrons to evenly crosslink both sides of the pellet from a single side bombardment. Of course, other members of the family of latent heat composite materials previously disclosed may also be used in this context as well.

FIG. 8 illustrates a symmetric food delivery device 153 that consists of two identical assemblies 124 and which can be used for delivery of a wide variety of different food items using disposable internal containers. FIG. 7 illustrates an exploded perspective view of one such assembly 124. The assembly 124 includes a preformed, rigid, polypropylene-walled, foam-filled half-container 126 and a heat retentive pellet 128 held in place by a nylon cover 129. The preformed walls of the half-container 126 are formed by rigid polypropylene sheets **126*a* and 126*b*, with an insulating foam 126*c* therebetween. The half-container 126 includes abase 130 and a continuous, upwardly extending, obliquely oriented sidewall 132 presenting an uppermost, substantially flat surface 134 interrupted by elongated concavities 134*a* along two side surfaces and corresponding elongated projections 134*b* along the other two side surfaces. The inside wall of base 130, formed of rigid polypropylene sheet 126*a*, has a central circular depression 136 formed therein, as well as four radially outwardly extending channels 138 communicating with the depression 136. It will be observed that the depression 136 is defined by an upright surface 140 interrupted by the channels 136 and having an upper lip 142. Additionally, the inside wall of base 130 has a stepped or tiered configuration between the channels 138, in the form of parallel ridge sections 144, 146. As best seen in FIGS. 11 and 13, the outside wall of base 130, formed of rigid polypropylene sheet 126*b*, has projecting feet 148 (in the form of flat-top cylinders ⅛" in height and 1" in diameter) and corresponding depressions 150 (⅛" in depth and 1.25" in diameter). Finally, the half-container 126 includes a valve stem 152 through the base 130** thereof.

The pellet 128 is preferably the same as that described in connection with the embodiments of FIGS. 5 and 6, except that the mass of synthetic resin material used in fabricating this pellet may be less. This reduction in material is possible because two pellets are used in each completed symmetric food delivery device, as will be described. Of course, other types of heat retentive materials previously described can be used in this context as well. In any case, the pellet 128 is secured within the central depression 136, with the pellet cover 129 engaging the half-container lip 142.

FIG. **8*a* illustrates a half-container 126 equipped with an RFID tag 151 in the base thereof; in this instance the tag 151 is embedded within a foot 148**.

In use, a pair of identical assemblies 124 are placed in face-to-face relationship to form a completed symmetric food delivery device 153 presenting an enclosed cavity 154, as seen in FIG. 8. To this end, the half-containers 126 are rotated so that the concavities 134*a* of the bottom half-container mate with the projections 134*b* of the upper half-container. If desired, one of the valves 152 may be employed for withdrawing a small amount of air from the cavity 154 so as to insure a tight vacuum-assisted fit between the half-containers 126. When the symmetric food delivery device 153 reaches its final destination, a valve 152 is manipulated to relieve the low magnitude vacuum within the container to thus permit the container halves to be separated.

FIG. 8 depicts a situation wherein two different sized pizza boxes 156, 158 are housed within the cavity 154 of the completed symmetric food delivery device 153. It will be seen that the ridges 144 and 146 form tiered surfaces which accommodate the different box sizes. That is, the outer ridges 146 of the lower half-container 126 are sized to accept the larger pizza box 156 whereas the inner ridges 144 of the upper half-container 126 accept the smaller pizza box 158. At the same time, the channels 138 assure that heated convection air travels radially outwardly from the pellet 128 to flow around and maintain the temperature of the pizza within the boxes 156, 158.

The completed symmetric food delivery device 153 may also accept a low-cost pizza box depicted in FIGS. 9 and 10. Specifically, the box 160 is formed of two half boxes 162. Each half box 162 (which may be constructed of standard cardboard, synthetic resin or molded pulp) presents a bottom wall 164, with a continuous, upstanding, oblique sidewall 166. The upper margins of the four sides of sidewall 166 have alternating tabs 168 and slots 170 so as to permit interconnection of the half boxes 162 as shown in FIG. 10. The use of boxes 160 within a container 153 is depicted in FIG. 14, where it will be seen that a pair of such boxes are oriented in stacked relationship with the bottom box 160 in close contact with the pellet 128 of the lower container half 126, whereas the upper box 160 is in close thermal contact with the pellet 128 of the corresponding upper container half 126.

One principal advantage of the symmetric food delivery device is that it may be used to deliver a variety of different foods packaged within novel disposable containers. As depicted in FIG. 15, a preformed synthetic resin sandwich-type container 172 can be seated within an open top liner 174 within the confines of the symmetric food delivery device 153. The liner 174 and the halves of container 172 are illustrated in exploded relation in the righthand portion of FIG. 15. In FIG. 16, the liner 174 is illustrated within the lower container half 126, and three separate food containers, made up of two containers 172 for hot foods and a central insulated container 178 for cold foods, is seated within the liner 174.

Another principal advantage of the symmetric food delivery device is that its half-containers 126 are fully nestable for ease of storage. As shown in FIG. 12, a pair of half-containers are in nested relationship with the feet 148 of the upper container half 126 engaging the inner surface of the base of the next lower container half. Thus, the feet 148 assure that the nested container halves may be readily separated.

Moreover, the location of the feet 140 and depressions 150 assists in the stable stacking of a plurality of symmetric food delivery devices 153. The feet 148 of an upper symmetric food delivery device 153 may be seated within the somewhat larger diameter depressions 150 formed in the upper surface of the next lower symmetric food delivery device 153, so as to form a more stable stack.

It will also be appreciated that the hard sided half-containers 126 may be charged with thermal energy via a magnetic induction charger of the type illustrated in FIG. 1. However, as shown in FIG. 17, a multiple-station charging/holding device 180 is preferably employed for the half containers 126 and the fully assembled symmetric food delivery devices 153. The device 180 is in the form of an insulated cabinet presenting a series of open lower vertical charging stations 182 for respective half containers 126. Each of the stations 182 includes a magnetic induction cooktop 184 identical to that shown in FIG. 1 without the attached locator/holder 36. It will further be observed that each station 182 is sized to snugly receive a half container 126 so as to assure that the pellet 128 thereof is closely adjacent the induction coil of the assembly 184. As will be appreciated, the respective half containers 126 can be situated within corresponding stations 182 for charging thereof as will be described, until the half containers are ready for use. If the half containers are then used to form completed containers 153 containing pizza boxes or the like, these completed and filled containers 153 can be stored and maintained at temperature in the upper horizontal holding stations 186. Again, each of these stations includes a pair of opposed, upper and lower magnetic induction charging assemblies 188, 190, and are sized to receive a pair of superposed containers 153. In this orientation, the lower pellet 128 of lower container 153 is closely adjacent the assembly 190, whereas the upper pellet 128 of the upper container 153 is proximal to upper charging assembly 188. This permits the user to extract two container halves 126 from the lower stations 182, to fill one of these with a food product and to use the other to close the filled half-container. The completed containers are then inserted into an upper station 186.

Operation

In order to understand the operation of the preferred apparatus of the invention, it is helpful to initially consider the disclosure of PCT Publication WO 98/05184, incorporated by reference herein. This disclosure describes two different temperature regulation techniques. Both methods utilize magnetic induction as the energy transfer means, a ferromagnetic heating element preferably composed of a nickel/copper alloy as the device whose temperature is regulated, and the concept of interrupting the continuous production of a magnetic field at a user-selective regulation temperature. However, each method uses a different feedback parameter related to the impedance of the load presented to the magnetic induction heater by the heating element to determine whether and when to interrupt magnetic field production.

The First Temperature Regulation Method of Publication WO 98/05184

The first technique involves regulation about an impedance threshold of a "no-load detector" forming a part of commercially available magnetic induction cooking device. In this method, a commercially available magnetic induction cooking device employing "abnormal load" or "no-load detection" circuitry, whose purpose is to prohibit continuous magnetic field production when the impedance of the load is improper, is used to temperature regulate a ferromagnetic heating element. FIG. 6A of Publication WO 98/05184 illustrates the operation of conventional "no-load detection" circuitry.

In many magnetic induction cooking devices the impedance that the external load presents to the resonant circuit is indirectly "detected" by measuring the amplitude of the resonant current flowing through the work coil. A variety of resonant circuit parameters may be used for such detection. Regardless of the exact circuit parameter measured, each commercially available "no-load" detection system ultimately reacts to a threshold value of load impedance, which was referred to in Publication WO 98/05184 as $Z_{detector}$ and which corresponds to a threshold value of resonant current amplitude, $I_{detector}$, below which the continuous magnetic field production is interrupted.

For this temperature regulation method to be successful, a ferromagnetic heating element magnetically coupled to the cooktop's work coil provides an impedance to the cooktop's resonant circuit that changes in a predictable, controlled fashion such that the amplitude of the resonant current, $I_{rc}$ consistently moves through the value of $I_{detector}$ at the same temperature. Provided this occurs, the cooktop's no-load detector de-energizes the current flowing through its induction work coil, thereby eliminating continuous magnetic field production and thus interrupting the joule heating of the heating element at the heating element's "user-selected regulation temperature" corresponding to the value of $I_{detector}$.

FIG. 21 shows a desired $I_{rc}$ vs. time (and temperature) relationship for a ferromagnetic heating element on a commercial induction cooktop employing this first temperature regulation method. FIG. 21 shows how the "user-selected regulation temperature" may be selected from any temperature within a range of temperatures from just above the published Curie temperature of the heating element up to a temperature defined as "the shelf temperature." The data graphed in FIG. 21 was obtained from a test conducted with a Sunpentown Model SR-1330 Induction Cooktop and a 5 inch square piece of 77% nickel/23% copper alloy sheet of 0.035 inch thickness. The sheet stock alloy square was placed upon the cooktop, centered over the work coil. The alloy square was prevented from warpage or movement throughout the test. A medium power setting was selected on the cooktop.

In order to properly comprehend the data graphed in FIG. 21, it is important to understand the basics of the Sunpentown SR-1330's no-load detection circuitry. Within this no-load detection circuit, a sensing transformer's primary has the SR-1330's resonant circuit current flowing through it. The transformer's seconday provides an induced EMF which results in current that, after rectification, is used by the no-load detector to determine if a proper load is in place upon the cooktop. The "transformer voltage", plotted in FIG. 21 is the voltage drop across a resistor, $R_{no\ load}$, through which this rectified secondary current flows. The "transformer voltage" is proportional to $I_{rc}$ and thus is proportional to the load impedance of the 77% nickel/23% copper alloy square. This transformer voltage was measured, recorded, and plotted every second by a Hewlett Packard 34970A Data Acquisition/Switch Unit interfaced with an IBM 770 ThinkPad™ computer running Hewlett Packard Benchlink™ Data Logger Software. Furthermore, an average temperature of the alloy square's surface was measured and recorded every second and plotted on the same graph For this test the $I_{detector}$ value of the SR-1330's no-load detector was lowered to a value corresponding to a voltage drop across $R_{no\ load}$ of 3.0 Volts, such that the continuous magnetic field was not interrupted through the test.

Again referring to FIG. 21, the transformer voltage remains between about 8.1 and 7.7 volts until the nickel/copper heating element exceeds approximately 225F. This temperature of 225F. is within experimental error of the published Curie temperature of an alloy of 77% nickel/23% copper with minimal trace elements. Thus, the temperature for which this first drastic drop in $I_{rc}$ occurs is hereafter referred to as the "published Curie temperature."

As the temperature of the alloy square increased above the published Curie temperature, the transformer voltage decreased drastically down to a value of 5.1V, at which time the transformer voltage remained essentially constant even as the alloy square's temperature continued to rise. The heating element's temperature at which the transformer voltage (and hence $I_{rc}$) remained essentially constant (determined as the temperature beyond the published Curie temperature at which the absolute value of the rate of change of transformer voltage first became less than one tenth the maximum rate of change value) is referred to herein as the "shelf temperature." Under these test conditions the shelf temperature of the 77% nickel/23% copper alloy square of thickness 0.035" is 290F. By adjusting the value of $I_{detector}$ (which may be done by adjusting a potentiometer accessible to the user) the user of the induction cooktop may select as the regulation temperature for the alloy square of this example any single temperature within the range of temperatures between 225F. and 290F.

The $I_{rc}$ vs. time (and temperature) curve for sheet stock heating elements of other nickel/copper alloys (different nickel percentages) under the same test conditions are almost identical in shape. Each curve shows the drastic drop in transformer voltage at the published Cure temperature and the essentially constant transformer voltage for all alloy temperatures beyond the shelf temperature.

FIG. 22 shows the $I_{rc}$ v. time relationship as well as the $I_{rc}$ vs. temperature relationship for a solid sheet alloy square that was actually temperature regulated via the first method of Publication WO 98/05184. A 5-inch 77% Nickel/23% copper alloy square was placed upon the same Sunpentown SR-1330 cooktop used to gather the data of FIG. 21. The same data gathering apparatus was used to record the transformer voltage and average temperature of the alloy square. In this case the alloy square was raised ¼ inch above the cooktop (whereas in FIG. 21 test the square was directly on the cooktop surface). As can be seen, the transformer voltage drops continuously until the average temperature of the square reaches approximately 247F. At this point, the transformer voltage drops to 4.74 volts, the voltage setting corresponding to $I_{detector}$. At this point, the no-load detector interrupts the continuous magnetic field production. The alloy square cools. Within four seconds the transformer voltage rises to approximately 5.74 volts, at which time the magnetic field was again produced continuously. The alloy square's temperature rose again. As the alloy square's temperature rose, the transformer voltage decreased again to the level corresponding to $I_{detector}$, and the continuous magnetic field production was interrupted. This process can be continued indefinitely. With a more significant heating load, the "on time" of the magnetic field would decrease dramatically.

FIG. 22 shows that the alloy disc regulated continuously at a temperature of 242±5F. when the voltage setting corresponding to $I_{detector}$ was set to 4.74 volts. If $I_{detector}$ had been set to correspond to 5.24 volts, the regulation temperature would have beeen approximately 235±5F. Furthermore, should the value of $I_{detector}$ been set to correspond to 5.74 volts, the regulation temperature would have been approximately 224±5F. Finally if the value of $I_{detector}$ had been set to correspond to 6.24 volts, the regulation temperature would have been approximately 210±5F. Thus, it can be seen that a variety of "user selected" regulation temperatures may be achieved with this temperature regulation method, by simply altering the value of $I_{detector}$.

Another means to vary the regulation temperature achieved by the first method of Publication WO 98/05184 is by altering the distance between the heating element and the induction cooktop's work coil. The effective load impedance that the heating element presents to the magnetic induction cooktop's work coil is dependent upon the distance between the heating element and the induction cooktop's work coil. Referring to FIG. 21, it can be seen that the transformer voltage corresponding to $I_{rc}$ drops from a value of 8.2 volts to a low of 5.1 volts for the apparatus used in this test. For the same apparatus, an increase in the distance between the heating element and the work coil would decrease both the maximum (previously 8.2 volts) and a minimum (previously 5.1 volts) voltages. Conversely, a decrease in the distance would increase both the maximum and minimum voltages. In both cases (increased and decreased distances), the transformer voltage versus time curves (and thus the value of $I_{rc}$ vs. time curves) are almost identical in shape.

Although this regulation method has many advantages, its main drawback is that the exact value of the load impedance is used as the magnetic field-controlling feedback parameter. Thus, all the factors that contribute to the exact value of the heating element's impedance (as presented to the resonant circuit) must be held substantially fixed for this method to give a reproducible regulation temperature from one test to another. In fact, the following main factors must be controlled so as to guarantee the exact same regulation temperature as expected trial after trial: (1) distance between heating element and work coil; (2) size of the heating element; (3) position of heating element over the work coil, and (4) line voltage.

The Second Temperature Regulation Method of Publication WO 98/05184

FIG. 6B Publication WO 98/05184 illustrates an alternate method of temperature regulation involving regulation about a specific rate of change of a circuit parameter that is proportional to the load impedance. This method virtually eliminates the dependence of the heating element's regulation temperature on the distance between the ferromagnetic heating element and the work coil. In this second method, two types of comparisons are made in determining whether to interrupt the continuous production of the magnetic field. The first comparison is similar to the comparison made in the Publication's first method. The measured impedance, $Z_{measured}$, as manifested by the amplitude of the resonant current during inverter on times, $I_{rc\ measured}$, is compared with a predetermined impedance level, $Z_1$, corresponding to a predetermined value $I_1$. If $I_{rc\ measured}$ is less than $I_1$, the control circuitry will interrupt the magnetic field and will cause periodic measurements of the amplitude of the resonant circuit current during inverter on times. As long as $I_{rc\ measured}$ is greater than $I_1$, a second comparison is made.

This second comparison is based on the absolute value of the change in impedance, $|\Delta Z|$, and therefore the absolute value of the change in resonant current amplitude, $|\Delta I_{rc}|$, between the present and immediate past measured current values, $I_{rc\ measured}$ and $I_{rc\ past}$, respectively. As is shown in FIG. 6B of Publication WO 98/05184, after the second measurement of the resonant current amplitude, the field will be interrupted if $|\Delta I_{rc}|$ is greater than a second pre-selected value, $I_2$. As long as $|\Delta I_{rc}|$ remains less than $I_2$, $I_{rc\ measured}$ will be re-measured, as shown in FIG. 6B. It is important to note that the second comparison can alternatively be used to interrupt the continuous production of the magnetic field if $|\Delta I_{rc}|$ is less than the second pre-selected value, $I_2$. Thus for this alternative, as long as $|\Delta I_{rc}|$ remains greater than $I_2$, $I_{rc\ measured}$ will be re-measured, as shown in the flow diagram, FIG. 6B.

The second comparison effectively eliminates the dependence of the self-regulation temperature on the distance between the heating element and the magnetic induction heating coil because the absolute value of the rate of change of the impedance of the heating element between its room temperature impedance temperature and its shelf temperature impedance is independent of the exact impedance value at any temperature in between. In other words, referring to FIG. 21, it does not matter what the exact value of the transformer voltage is at the room temperature of the heating element: the shape of the transformer voltage vs. time curve stays essentially the same regardless of the distance between the heating element and the induction work coil. Therefore, by selecting a particular value of $|\Delta I_{rc}|$, namely $I_2$, for a specific time interval, $\Delta$time, during which the second comparison is made, a particular temperature (within a small temperature range), corresponding to that value $|\Delta I_{rc}/\Delta\ \text{time}|$ becomes the self-regulation temperature, regardless of that temperature's corresponding value of $I_{rc\ measured}$.

This second temperature regulation method not only virtually eliminates the dependence of the self-regulation temperature on the distance between the heating element and the magnetic induction coil, it also virtually eliminates the heating element regulation temperature's dependence upon the other factors that determine the amplitude of the resonant current when a heating element is magnetically coupled to the work coil: (1) size of the heating element; (2) horizontal position of heating element over the work coil; and (3) line voltage.

The term "virtually eliminates" is used because each of the above factors can still slightly influence the regulation temperature as follows. If the diameter of a flat disc heating element is much larger than the diameter of the flat pancake induction work coil, then the disc will temperature regulate when the disc's surface within the work coil diameter is much hotter than the outer disc surface. Also, as the disc is moved further away from the work coil, the inner diameter hot zone will change in size. Furthermore, if a disc heating element is not centered over the work coil, the portion of the disc directly over the work coil will temperature regulate at a hotter temperature than the portion not over the work coil. Finally, a wildly fluctuating line voltage can confuse the rate of change detector as described in this second method of Publication WO 98/05184, inasmuch as the value of each individual value of $I_{rc\ measured}$ depends upon the line voltage amplitude. However, typically line voltage fluctuations only temporarily interrupt the magnetic field production prematurely while the heating element is yet below the user-selected regulation temperature. Once the heating element is regulating about the user-selected regulation temperature, a typical line voltage fluctuation may cause the magnetic field to be produced when it should be interrupted, causing only a temporary overheating of the element. Of course, methods known in the art to eliminate or compensate for line voltage fluctuations can avoid this problem.

Despite the advantages of the second method over the first method of Publication WO 98/05184, further research and testing of prototype cooktops employing the second method and using nickel/copper alloy heating elements have shown that in many cases only two distinct temperature ranges provide enough resolution (i.e., show enough rate of change of the rate of change in the resonant circuit current—essentially $|d^2I_{rc}/d(\text{time})^2|$) so as to temperature regulate precisely. Referring to FIG. 23, two regions of the transformer voltage vs. time curve are highlighted and their corresponding temperature regions are bracketed: (1) the region corresponding to temperatures immediately following the published Curie temperature, labeled the "Curie Region," and (2) the region corresponding to temperatures immediately about the self temperature, labeled the "Shelf Region." At other temperatures between the Curie Region and the Shelf Region for selected nickel/copper alloy heating elements, the second temperature regulation method of Publication WO 98/05184 does not allow precise temperature regulation.

The Preferred Temperature Regulation Method of the Invention

The preferred temperature regulation method of this invention combines elements of both methods of Publication WO 98/05184 in a new way. In summary, the preferred method indirectly detects the impedance of the external load presented by a ferromagnetic induction heating element to the resonant circuit of a magnetic induction heater, by measuring an appropriate feedback parameter related to such impedance and in a way to avoid the potential problems of the first and second temperature regulation methods described in Publication No. WO 98/05184. This is done by periodically measuring the amplitude of the resonant circuit current, $I_{rc}$, via a sensing transformer through whose primary flows the cooktop's work coil current.

At the outset it should be understood that only one magnetic induction cooktop circuit feedback parameter is measured and fed to the control circuit that determines when the magnetic field is to be produced and when it is to be interrupted: the amplitude of the resonant circuit current, $I_{rc}$. It is also to be understood the amplitude of the resonant current, $I_{rc}$ is preferably determined by measuring the amplitude of current that has been induced in a detection circuit forming a part of the magnetic induction heater during heating operations. As illustrated in FIG. 18, a portion of the resonant circuit that includes the work or induction coil 70 is a primary with respect to the secondary sensing coil 72; therefore, the impedance of the external load may be detected in this arrangement by measuring the amplitude of the rectified current induced in the coil 72 and its connected control circuit 74. All logical operation conducted by the microprocessor control circuit 74 use this raw data.

The entire FIGS. 19A and 19B flow chart of 32 steps can be thought of as three interconnected logical loops. Logic loop #1 is called the "ready loop" and encompasses steps 200–210, inclusive, of the flow chart. Logic loop #1 performs a function very similar to the "no-load" detector previously described, i.e., it insures that only a load with the proper impedance, preferably a food container with a desired ferromagnetic heating element installed, will ever receive full power from the cooktop.

Full power to charge the pellet within the food container is provided in logic loop #2 (the "full charge" loop), encompassing steps 212–236, inclusive. Logic loop #2 implements the rate of change of load impedance detection method similar to the second temperature regulation methods of PCT Publication No. WO 98/01584, and solves the potential problem of having the ferromagnetic heating element at variable distances from the work coil of the cooktop. The full charge loop charges the pellet with full power until its heating element's temperature reaches the shelf temperature, at which time the full power magnetic field is interrupted and the cooktop controller moves to logic loop #3 (the "temperature holding" loop). The full charge loop #2 also insures that the magnetic field is not interrupted at or before the Curie temperature; as seen in FIG. 21, there is a region immediately adjacent the Curie temperature having a rate of change which could interrupt the magnetic field and terminate heating at a heating element temperature just below the Curie Temperature region. Such result is avoided because of the value $S_n$, i.e., when the absolute change in $I_{rc}$, $|\Delta I_{rc}|$, during a selected time period $\Delta t_2$ is greater than this selected $S_n$ (whose value, divided by the time interval $\Delta t_2$, corresponds to a threshold value of the absolute rate of change of $I_{rc}$), one is assured of being between the Cure temperature and the shelf temperature and the counter is set to EP=1.

Logic loop #3 (steps 238–262 inclusive) maintains the pellet temperature near the shelf temperature and notifies the user that the pellet is fully charged. Logic loop #3 performs analogously to the first temperature regulation method of PCT Publication No. WO 98/10584, except that full power is not applied to the pellet within this loop. The cooktop functions within logic loop #3 until the user either removes the fully charged pellet, at which time the cooktop reverts to logic loop #1, or the pellet's heating element temperature drops below a certain percentage of the shelf temperature, at which time the cooktop reverts to logic loop #2.

There are nine pre-programmed values used in the logic comparisons of the FIGS. 19A and 19B flow chart: (1) $I_1$, the lower boundary for resonant current; (2) $I_{10}$, the upper boundary for resonant current; (3) $\Delta t_1$, the time interval employed within logic loop #1; (4) $\Delta t_2$, the time interval employed within logic loop #2; (5) $S_N$, a selected value of the absolute change in resonant current amplitude during a selected time period $\Delta t_2$ ($S_n$ divided by $\Delta t_2$ corresponds to a selected absolute value of a rate of change $I_{rc}$) that is always achieved for a given heating element between its Curie temperature and shelf temperature; (6) RT, a time value chosen such that the pellet is considered charged if the cooktop remains in logic loop #3 for this amount of time; (7) f, the percentage change in resonant current from $I_{shelf}$ that is allowed before forcing the cooktop to re-enter logic loop #2; (8) $I_2$, the absolute change in resonant current amplitude during a selected time period $\Delta t_2$ ($I_2$ divided by $\Delta t_2$ corresponds to a selected absolute value of the rate of change of $I_{rc}$) that corresponds to the chosen regulation temperature; and (9) $\Delta t_{PING}$, the selected time interval employed in logic loop #3. These values are chosen in relation to the specific magnetic induction heating element chosen for a particular application, and vary so as to achieve the desired temperature maintenance for each respective pellet.

Furthermore, there are 7 memory sites whose values are set and reset at specified times throughout the operation of the cooktop, as described by the FIGS. 19A and 19B flow chart. These values are: (1) $I_{rc\ measured}$, a snapshot value of resonant current amplitude; (2) $I_{rc\ past}$, another snapshot value of resonant current amplitude; (3) $|\Delta I_{rc}|=|I_{rc\ measured}-I_{rc\ past}|$, the absolute change in resonant current amplitude during a selected time period $\Delta t_2$ ($|\Delta I_{rc}|$ divided by $\Delta t_2$ corresponds to the absolute value of the rate of change of $I_{rc}$); (4) EP, a logical 1 or 0 used to enable magnetic field interruption by the rate of change detector of logic loop #2; (5) $I_{shelf}$, the amplitude of the resonant current corresponding to the pellet heating element's shelf temperature; (6) $I_{rc\ PING}$, a snapshot value of the amplitude of resonant current measured within logic loop #3; and (7) PING TIME, the cumulative time that the cooktop has remained operating under logic loop #3 rules. In all cases, the $I_{rc}$ values are averages obtained by measuring a plurality of successive values (e.g., 4), summing these values and dividing by the number of values measured.

Prior to applying power to the cooktop, all 9 preprogrammed values will exist within the cooktop's microprocessor, whereas all 7 memory sites will be set to the value zero. Once power is applied and the container sensor signals the presence of a food container, the microprocessor moves to step 200 (FIGS. 19A and 19B). Here the magnetic field is generated in a low duty cycle mode, typically for one cycle every 60 available power cycles. If no suitable pellet is within the food container placed upon the charging station, the cooktop's microprocessor logic flows from step 200–204, to 208, then 210, and back again to step 200 after the interval $\Delta t_1$. Should a foreign object be placed upon a cooktop operating in logic loop #1 such that the load impedance causes the resonant circuit to draw excessive current, the microprocessor logic would flow from steps 200–210, and back again. This is because during step 206, a determination is made as to whether $I_{rc}$ is greater than $I_{10}$, the selected upper boundary for resonant current. If this condition is satisfied by a YES, an object other than the designed heating element has been placed upon the induction heater, and therefore to avoid overheating thereof, the circuit interrupts the magnetic field at step 208. In either case, the cooktop remains in a low power pulsing mode, searching for a proper load. Once a food container having an appropriate ferromagnetic heating element pellet of this invention is placed upon the cooktop, the cooktop leaves logic loop #1 and enters logic loop #2.

At step 212, full power is initiated. Full power is defined as production of a magnetic field for at least 50 and more preferably 59 or 60 of every 60 available power cycles. At step 214, the charging light on the status indicator box 46 (FIG. 1) is illuminated. In step 216, the microprocessor delays for a time equal to $\Delta t_2$ and then measures $I_{rc}$ and stores this value as $I_{rc\ measured}$ in step 218. Referring to FIGS. 21 and 23, it will be seen that at temperatures below the published Curie temperature, the resonant current amplitude changes very little. Therefore, by step 220 the value of $|\Delta I_{rc}|=|I_{rc\ measured}-I_{rc\ past}|$ will be very small. Thus, the answer to the question in step 222 will be NO, since the value of $S_N$ is typically chosen to be at least two times the absolute value of the highest value of $|\Delta I_{rc}|$ for pellet temperatures below the published Curie temperature. Thus, EP will stay a logical 0 until the pellet's heating element temperature passes the Curie region. This means that the answer to the question at step 226 will also remain a NO. The microprocessor then sets $I_{rc\ past}$ equal to $I_{rc\ measured}$ in step 228 and determines if $I_{rc\ past}$ is less than $I_1$ in step 230 and if $I_{rc\ past}$ is greater than $I_{10}$ in step 232. At this point, the answers to steps 230 and 232 are NO, and thus, after a time interval of $\Delta t_2$, the logic steps 218–232 will be repeated again, unless the food container is removed or altered. If this should occur, either step 230 or 232 would interrupt the magnetic field and send the control circuit back into logic loop #1.

The reason for the inclusion of the logic value EP in steps 222–226 is to prevent step 236 from interrupting full power charging and mistakenly sending the cooktop into the holding mode of logic loop #3 while the pellet is still in the region of temperatures prior to the Curie region. Thus, the pellet's heating element will continue to increase in temperature until it reaches a temperature near to the shelf temperature at which time the answer to question 222 will become a YES. Some time multiple of $\Delta t_2$ later, the pellet's heating element temperature will reach the shelf temperature where the value of $|\Delta I_{rc}|$ becomes less than $I_2$. At the shelf temperature the answer to question 226 becomes a YES, production of the magnetic field is interrupted, and the value of $I_{rc\ measured}$ is stored in memory as $I_{shelf}$. At this time the control circuit moves to logic loop #3 beginning at step 238 in FIG. 19B.

Should a container/pellet that has come back from a delivery cycle with its heating element temperature above the published Curie temperature be placed upon the cooktop, the control circuit would proceed to step 236 as described above. However, the value EP would become a logical 1 via steps 222 and 224 and the answer to question 226 would become a YES much sooner. Thus, while the cooktop would still leave logic loop #2 for logic loop #3 with the pellet's heating element temperature at the shelf temperature, the time spent in logic loop #2 would be much less.

Although the pellet's heating element has reached the shelf temperature at step 236 of the control circuit flow chart, some of the synthetic resin heat retentive material encasing the heating element that makes up the bulk of the pellet may not have reached the shelf temperature. Thus, one need for logic loop #3 is to allow temperature equalization between the ferromagnetic core and the surrounding synthetic resin heat retentive material of the pellet prior to giving the user the "ready" light on the charging station's status indicator box. The other reason for logic loop #3 is to allow the heating element to maintain a regulation temperature in a small range about the shelf temperature for as long as the container/pellet remains on the charging station.

Logic loop #3 begins a time interval $\Delta t_{PING}$ after the shelf temperature has been reached and a corresponding value of resonant current amplitude, $I_{shelf}$, has been stored in memory. Steps 240, 242, 248, 254, 256, and 258 constitute a modified version of the first temperature regulation method of Publication No. WO 98/01584: that is, the feedback information used to determine when to interrupt magnetic field production is based solely upon the load impedance itself at a given time, as reflected in the measured value $I_{rc}$. At step 240, the magnetic field is generated continuously at a low power level, typically for 4 out of every available 60 power cycles. At step 242, the measured value of $I_{rc}$ is stored in memory as $I_{rc\ PING}$. Step 244 determines if the PING time is greater than $R_t$, which at this point is NO. Therefore, the microprocessor skips to step 248. Referring to FIG. 23, at this point the pellet's heating element will have cooled very little. Thus the value of $I_{rc\ PING}$ will be very close to the value of $I_{shelf}$. Thus when step 248 calculates the percentage difference in $I_{rc\ PING}$ from the stored value of $I_{shelf}$, it will be a very small value, say for example 0.5%. At this point, the answers to steps 250 and 252 are both NO. Assuming that the value of f is chosen to be 5%, the answer to question 254 will be NO, and thus the magnetic field will be interrupted in step 256, and the microprocessor will wait a time interval $\Delta t_{ping}$ in step 258 and add $\Delta t_{ping}$ to the PING time in step 260.

At time intervals of $\Delta t_{PING}$, the sequence of steps 240, 242, 248, 254, 256 and 258 will be repeated until the temperature of the heating element drops enough so that its load impedance, and therefore the value of $I_{rc\ PING}$, rises enough such that the percentage difference of $I_{rc\ PING}$ from the stored value of $I_{shelf}$ is more than the value f. At this time, the answer to question 254 will be YES and the control circuit will transition back to logic loop #2, the charging loop.

Within logic loop #3 are two other important functions. Steps 250 and 252 ensure that the magnetic field will be interrupted and the cooktop will revert to logic loop #1 that should the container/pellet be removed from the charging station or somehow altered. Steps 244, 246, 260 and 262 constitute a time counter that causes the "charging" light on the charging station's status indicator box to go off, while simultaneously causing the "ready" light to turn on after the charger has remained solely within logic loop #3 longer than a pre-determined time interval RT.

Different pre-programmed values of $I_2$, $\Delta t_2$, $\Delta t_{PING}$, and f will alter both the exact regulation temperature and the Δtemperature about the regulation temperature that this preferred method of temperature regulation achieves. Slight alterations in the flow chart of FIGS. 19A and 19B can also provide temperature regulation methods with other features as well. For instance, should a logic loop #4 consisting of simply another modified version of logic loop #1 be added to the YES branch of step 254, the pellet would temperature regulate at a new temperature between the shelf temperature and the published Curie temperature despite the fact that its heating element first had been heated to the shelf temperature. FIG. 20 shows such a logic loop #4, consisting of steps 264–276. This loop #4 is very similar to loop #1.

One advantage of the temperature regulation method shown in FIG. 20 is a faster charging time to the intended regulation temperature of a pellet. This can be achieved since the heating element has a higher ultimate charging temperature, corresponding to $I_{shelf}$, than the regulation temperature, corresponding to the value of $I_{rc}$ that satisfies the equation $|[\{I_{rc}/I_{shelf}\}-1\}*100]|=f$. If the value chosen for parameter f is relatively larger, the regulation temperature moves closer to the Curie temperature; correspondingly, as the value of f is made relatively smaller, the regulation temperature moves closer to the shelf temperature.

Thus, slight modifications to the preferred regulation method of this invention as described in FIGS. 19A and 19B can achieve different regulation temperatures for the same heating element. It will thus be appreciated that a variety of analogous algorithms may be used for such modification.

The operation of the invention will be described with reference to the pizza bag 76 of FIG. 2 and the charging station 32. However, it will be appreciated that this explanation is equally applicable to the other heating elements and containers previously described. In the first step, the switch 48 of a station 32 is turned ON and the user places the bag 76 containing the pellet 86 on the holder/locator 36 of the charging station 32. Such placement is initially sensed by the locating photo sensors 56, 58 which sends an initiation signal to the microprocessor of the cooktop and allows heating to commence. The microprocessor then initiates the sequence of steps set forth in FIGS. 19A and 19B (assuming that the user desires to regulate the temperature about the shelf temperature of the element 86). In logic loop #1, the presence of the pellet 86 on the charging station is confirmed. The microprocessor then proceeds to logic loop #2 where a magnetic field is generated in step 212 and the charging light 54 is turned on. This serves to initiate heating of the heating element 90 which continues until the regulation (shelf) temperature is achieved (step 236). The microprocessor then proceeds to logic loop #3 which serves to maintain the temperature of the pellet 86 near the shelf temperature and turns off charging light 54 and illuminates ready light 52. This of course notifies the user that pellet 86 within pizza bag 76 is fully charged and ready for use.

One or more pizzas are placed within the bag 76 as shown in FIG. 2, and the flap 78 is closed. The closed bag 76 is then removed from the charging station 32 and the pizza is delivered to the customer. During transit, the pellet 86 serves to substantially maintain the bag contents at the desired temperature. The pellet 86 and its heat retentive material 92 is capable of maintaining temperature over relatively long periods of time. For example, as illustrated in FIG. 24, two commercially available boxed pizzas at 190F. were placed within a bag 76 having a fully charged pellet 86 (FIG. 3) therein. Over a period of 40 minutes, the bottom pizza decreased in temperature to about 160F., whereas the top pizza decreased to a temperature of about 153F. This is very effective temperature maintenance, particularly when it is considered that many delivery times are substantially less than 40 minutes.

As explained above, if a user desires to regulate the pellet at a temperature below the shelf temperature of the ferromagnetic heating element, this can readily be accomplished. One way of doing this is shown in FIG. 20, explained previously. In practice, regulation can be achieved at virtually any temperature between the Curie and shelf temperatures of the heating element.

The preferred indicator box 46 associated with each station 32 has a user-operated temperature input feature allowing a user to select any one of a number of regulation temperatures within the regulatable range of the heating element. The cooktop microprocessor also has in look up table memory different values for the 9 initial program values described above ($I_1$, $I_{10}$, $\Delta t_1$, $\Delta t_2$, $S_n$, RT, f, $I_2$ and $\Delta t_{PING}$) which correspond to each user selectable regulation temperature. If the range between the Curie and shelf temperatures of the associated heating element 90 is 230F.–290F., the user may select a regulation temperature of 250F. The microprocessor then retrieves from memory the 9 initial program values corresponding to a 250F. regulation temperature and uses these values in the temperature control sequence.

Where the bag 76 has an RFID tag and the station 32 includes an appropriate RFID reader, additional benefits can be obtained. For example, this would permit use of different sizes or configurations of bags 76 on a given charging station 32. If a small bag were placed on the charging station, the RFID reader, sensing the small bag RFID tag code, would initiate a temperature control sequence appropriate for the small bag. Similarly, if a larger bag were placed on the charging station, the RFID reader would sense a different RFID tag and begin a temperature control sequence better suited to the larger bag. Of course, the microprocessor would have in look up table memory the 9 initial program values corresponding to each of these sequences.

Furthermore, use of RFID technology would allow a business owner to determine the number of delivery trips for each bag 76 and the duration of each such trip. The RFID tags associated with each bag could include timer and count circuitry which would be read by the reader on a continuing basis. This would give the owner detailed information about delivery performance not otherwise readily obtainable.

What is claimed is:

1. Apparatus comprising:

a magnetic induction heater including a magnetic field generator for generating a magnetic field, said heater having an RFID reader associated therewith;

an object to be magnetically heated including an induction heatable element and an RFID tag, and said heater having a microprocessor operably connected with said RFID reader for initiating the heating of said object only upon placement of said object proximal to said heater and in a position for RF communication between said tag and said reader, and for controlling the operation of said heater in response to information received from said tag.

2. The apparatus of claim 1, said object comprising a food-holding container including an induction heating element.

3. The apparatus of claim 1, said microprocessor operable to initiate different heater operation sequences in response to said information received from said tag.

4. A method of heating an object comprising the steps of:

providing a magnetic induction heater including a magnetic field generator for generating a magnetic field, said heater having an RFID reader associated therewith;

providing an object to be magnetically heated including an induction heatable element and an RFID tag, and placing said object proximal to said heater in a location for magnetic induction heating of said element and in a position for RF communication between said tag and said reader; and initiating the heating of said object and controlling the operation of said heater only in response to said placement of said object and receipt of information from said tag.

5. The method of claim 4, said object comprising a food-holding container, said method including the step of placing food to be heated within said container.

6. The method of claim 4, said initiating and controlling step being carried out using a microprocessor.

7. The method of claim 6, said microprocessor operable to initiate different heater operation sequences in response to said information received from said tag.

8. A food delivery system comprising:

a food-holding container including an induction heatable element;

a magnetic induction heater including a magnetic field generator for generating a magnetic field, said heater operable to heat said element while the element is magnetically coupled with said magnetic field and said element remains within said container; and a temperature controller operable to control the temperature of said element during the course of heating of the element including a detector operable to detect an induction heater circuit parameter whose magnitude is dependent upon the impedance presented by the heating element when the element is magnetically coupled with said magnetic field, and control circuitry operable to alter the magnetic field strength of said magnetic field in response to the magnitude, or rate of change of said magnitude, of said detected parameter, during said course of heating.

9. The system of claim 8, said detector being a current-sensing transformer.

10. The system of claim 8, said container comprising a flexible insulated bag sized to hold one or more pizzas.

11. The system of claim 10, said bag including an internal pocket, said heating element being located within said pocket.

12. The system of claim 8, said element comprising a ferrogmagnetic core encased within synthetic resin heat retentive material.

13. The system of claim 12, said heat retentive material being solid-to-solid phase change heat retentive material.

14. The system of claim 8, including an RFID tag associated with said container and an RFID reader associated with said heater.

15. The system of claim 14, said heater having a microprocessor operably connected with said RFID reader for initiating the heating of said element only upon placement of said container proximal to said heater and in a position for RF communication between said tag and said reader, and for controlling the operation of said heater in response to information received from said tag.

16. The system of claim 15, said microprocessor operable to initiate different heater operation sequences in response to said information received from said tag.

17. A method of delivering a hot food product comprising the steps of:

providing a food-holding container including an induction heatable element;

providing a magnetic induction heater including a magnetic field generator for generating a magnetic field;

placing said container adjacent said heater to heat the element to a desired temperature;

controlling the temperature of said element during the course of heating of the element by detecting an induction heater circuit parameter whose magnitude is dependent upon the impedance presented by the heating element when the element is magnetically coupled with said magnetic field, and altering the magnetic field strength of said magnetic field in response to the magnitude, or rate of change of said magnitude, of said detected parameter, during said course of heating;

inserting said hot food product within the container, and withdrawing said container from said magnetic field; and delivering said hot food product in said container a remote delivery location, and removing the food product therefrom.

18. The method of claim 17, said inserting step being carried out after said withdrawing step.

19. A food delivery assembly comprising:

a container adapted to receive and hold food; and an induction heating element carried by said container and heatable when coupled with an externally applied magnetic field, while said element remains a part of said container, said element comprising a ferromagnetic induction heatable body encapsulated within solid-to-solid phase change synthetic resin material, said body heatable to a temperature above the phase change temperature of said synthetic resin material when coupled with an externally applied magnetic field, said synthetic resin material including a crosslinked polyethylene-containing matrix.

20. The assembly of claim 19, including respective amounts of glass particles and carbon powder within said matrix.

21. The assembly of claim 19, said matrix comprising at least about 70% by weight polyethylene.

22. The assembly of claim 19, said element formed by molding said material about said body and thereafter radiation-crosslinking the material.

23. The assembly of claim 19, said body formed of a nickel/copper alloy.

24. In a magnetic induction heating assembly including a magnetic induction heater having a magnetic field generator and an object to be magnetically heated including an induction heatable element, the improvement which comprises an RFID tag associated with said object, an RFID tag reader associated with said heater, and a microprocessor operably coupled with the reader for at least in part controlling the heating of the object in response to information received by the reader from the RFID tag, when the object is placed proximal to the heater in a position for RF communication between the tag and reader, and heating of the object is initiated.

25. The assembly of claim 24, said microprocessor operable to initiate the heating of said object when the object is placed in said position.

* * * * *